US010311667B2

(12) United States Patent
Loyed et al.

(10) Patent No.: US 10,311,667 B2
(45) Date of Patent: Jun. 4, 2019

(54) GAMING SYSTEM VOLATILITY MARKER AND GAMING SYSTEM HAVING A VOLATILITY MARKER

(71) Applicant: IGT, Las Vegas, NV (US)

(72) Inventors: William Robin Loyed, Las Vegas, NV (US); William Berry Cane, Sparks, NV (US)

(73) Assignee: IGT, Las Vegas, NV (US)

( * ) Notice: Subject to any disclaimer, the term of this patent is extended or adjusted under 35 U.S.C. 154(b) by 576 days.

(21) Appl. No.: 14/293,689

(22) Filed: Jun. 2, 2014

(65) Prior Publication Data

US 2015/0348356 A1 Dec. 3, 2015

(51) Int. Cl.
*G07F 17/32* (2006.01)

(52) U.S. Cl.
CPC ..... *G07F 17/3211* (2013.01); *G07F 17/3204* (2013.01)

(58) Field of Classification Search
CPC ..... A63F 9/24
USPC ..... 463/16
See application file for complete search history.

(56) References Cited

U.S. PATENT DOCUMENTS

| | | | |
|---|---|---|---|
| 4,553,748 | A | 11/1985 | Allen et al. |
| 5,429,361 | A | 7/1995 | Raven et al. |
| 5,478,086 | A | 12/1995 | Aylett |
| 6,062,981 | A | 5/2000 | Luciano, Jr. |
| 6,302,791 | B1 | 10/2001 | Frohm et al. |
| 6,599,192 | B1 | 7/2003 | Baerlocher et al. |
| 6,712,693 | B1 | 3/2004 | Hettinger |
| 6,939,224 | B2 | 9/2005 | Palmer et al. |
| 7,207,883 | B2 | 4/2007 | Nozaki et al. |

(Continued)

FOREIGN PATENT DOCUMENTS

| | | |
|---|---|---|
| EP | 1 126 426 | 8/2001 |
| EP | 1 498 857 | 1/2005 |

(Continued)

OTHER PUBLICATIONS

"U1 Gaming," The Wizard of Odds, available at http://wizardofodds.com/games/keno/u1/, updated Jun. 18, 2013 (8 pages).

(Continued)

*Primary Examiner* — Tramar Y Harper
*Assistant Examiner* — Jeffrey K Wong
(74) *Attorney, Agent, or Firm* — Neal, Gerber & Eisenberg LLP

(57) ABSTRACT

Various embodiments of the present disclosure generally relate to: (a) a volatility marker attachable to a gaming system to indicate to a player the volatility level of the gaming system; (b) a volatility marker attachable to a gaming system to indicate to a player the volatility level of the gaming system compared to other gaming systems; (c) a gaming system including a volatility marker that indicates to a player the volatility level of the gaming system; (d) a gaming system including a volatility marker that indicates to a player the relative volatility level of the gaming system compared to other gaming systems; (e) a method for causing a gaming system to indicate to a player the volatility level of the gaming system; and (f) a method for causing a gaming system to indicate to a player the relative volatility level of the gaming system compared to other gaming systems.

32 Claims, 26 Drawing Sheets

(56) References Cited

U.S. PATENT DOCUMENTS

| | | | | |
|---|---|---|---|---|
| 7,374,485 | B2 | 5/2008 | Mezen et al. | |
| 7,563,167 | B2 | 7/2009 | Walker et al. | |
| 7,686,685 | B2 | 3/2010 | Englman et al. | |
| 7,722,456 | B2 | 5/2010 | Walker et al. | |
| 7,780,520 | B2 | 8/2010 | Baerlocher | |
| 8,002,621 | B2 | 8/2011 | Mattice et al. | |
| 8,075,381 | B2 | 12/2011 | Inamura | |
| 8,083,582 | B2 | 12/2011 | Kato | |
| 8,105,146 | B2 | 1/2012 | Inamura | |
| 8,109,822 | B2 | 2/2012 | Inamura | |
| 8,113,946 | B2 | 2/2012 | Walker et al. | |
| 8,118,661 | B2 | 2/2012 | Inamura | |
| 8,162,746 | B2 | 4/2012 | Nicely et al. | |
| 8,167,699 | B2 | 5/2012 | Inamura | |
| 8,182,331 | B2 | 5/2012 | Okada | |
| 8,235,809 | B2 | 8/2012 | Sugiyama | |
| 8,328,627 | B2 | 12/2012 | Mezen et al. | |
| 8,371,927 | B2 | 2/2013 | Englman | |
| 8,398,473 | B2 | 3/2013 | Baerlocher et al. | |
| 8,506,380 | B2 | 8/2013 | Hughes et al. | |
| 8,550,912 | B2 | 10/2013 | Lanning et al. | |
| 8,641,502 | B2 | 2/2014 | Kato | |
| 2002/0086726 | A1 | 7/2002 | Ainsworth | |
| 2003/0008702 | A1 | 1/2003 | Meyer | |
| 2003/0207709 | A1 | 11/2003 | Paotrakui | |
| 2004/0053672 | A1 | 3/2004 | Baerlocher | |
| 2004/0121833 | A1 | 6/2004 | Mezen et al. | |
| 2005/0187006 | A1 | 8/2005 | Tachikawa | |
| 2005/0282615 | A1 | 12/2005 | Englman et al. | |
| 2006/0084496 | A1* | 4/2006 | Jaffe | G07F 17/3239 463/20 |
| 2007/0060252 | A1* | 3/2007 | Taylor | G07F 17/32 463/16 |
| 2008/0076553 | A1 | 3/2008 | Paulsen et al. | |
| 2008/0081689 | A1 | 4/2008 | Seelig et al. | |
| 2008/0113707 | A1 | 5/2008 | Nesemeier et al. | |
| 2008/0200230 | A1 | 8/2008 | Mezen et al. | |
| 2009/0088239 | A1 | 4/2009 | Iddings et al. | |
| 2009/0156289 | A1 | 6/2009 | Inamura | |
| 2009/0156290 | A1 | 6/2009 | Inamura | |
| 2009/0156291 | A1 | 6/2009 | Inamura | |
| 2009/0156293 | A1 | 6/2009 | Inamura | |
| 2009/0233690 | A1 | 9/2009 | Okada | |
| 2009/0233712 | A1 | 9/2009 | Okada | |
| 2009/0247284 | A1 | 10/2009 | Sugiyama | |
| 2009/0264194 | A1 | 10/2009 | Kompella | |
| 2009/0288039 | A1* | 11/2009 | Mail | G06F 3/038 715/815 |
| 2010/0004047 | A1 | 1/2010 | Acres | |
| 2010/0016055 | A1 | 1/2010 | Englman | |
| 2010/0041461 | A1* | 2/2010 | Demsetz | G07F 17/32 463/20 |
| 2010/0120506 | A1 | 5/2010 | Davis et al. | |
| 2011/0045894 | A1 | 2/2011 | Owen | |
| 2011/0111826 | A1 | 5/2011 | Baerlocher et al. | |
| 2011/0111828 | A1 | 5/2011 | Caputo et al. | |
| 2013/0040731 | A1 | 2/2013 | Bernard et al. | |
| 2013/0079097 | A1 | 3/2013 | Nicely | |
| 2013/0079104 | A1 | 3/2013 | Delekta | |
| 2013/0102386 | A1 | 4/2013 | Mezen et al. | |
| 2013/0157733 | A1 | 6/2013 | Thorne et al. | |
| 2013/0217466 | A1 | 8/2013 | Fujisawa et al. | |
| 2013/0217468 | A1 | 8/2013 | Fujisawa et al. | |
| 2013/0244756 | A1 | 9/2013 | Wells | |
| 2013/0273997 | A1 | 10/2013 | Stewart | |
| 2013/0274012 | A1 | 10/2013 | Aoki et al. | |
| 2014/0256408 | A1 | 9/2014 | Meyer | |
| 2015/0348356 | A1 | 12/2015 | Loyed | |
| 2015/0363976 | A1 | 12/2015 | Henson | |

FOREIGN PATENT DOCUMENTS

| | | |
|---|---|---|
| EP | 1 560 178 | 8/2005 |
| WO | WO 2007/002095 | 1/2007 |

OTHER PUBLICATIONS

International Search Report and the Written Opinion of the International Searching Authority for International Application No. PCT/US2015/031389 dated Aug. 2, 2015.

Wayne.Roller Coaster Physics by Tony Wayne. 1998. [retrieved on Jul. 30, 2015]. Retrieved from the Internet<URL:http://www.e-booksdirectory.com/details.php?ebook=2269>. entire document.

International Preliminary Report on Patentability for International Application No. PCT/US2015/031389 dated Dec. 6, 2016.

* cited by examiner

GAMING SYSTEM VOLATILITY MARKER AND GAMING SYSTEM HAVING A VOLATILITY MARKER

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in larger awards being provided when they do occur.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Various gaming systems are configured, on average, to pay back to players a certain percentage of the amount of money wagered by the players on plays of games on those gaming systems. The average percentage of money wagered on a particular gaming system that is paid back to players of that gaming system is typically called the average expected payback percentage, the average expected payback, or the average expected return of that gaming system. The more plays of the game(s) that are provided by a particular gaming system, the more likely that the actual payback percentage of that gaming system will approach the average expected payback percentage of that gaming system.

More specifically, for a particular gaming system, the average expected payback percentage of that gaming system is determined based on or otherwise depends on the average expected payback percentage(s) of the game(s) that that particular gaming system is configured to operate. For instance, if a gaming system is configured to operate only one game, such as a primary poker game, the average expected payback percentage of the gaming system is the same as the average expected payback percentage of the primary poker game. In another example, if the gaming system is configured to operate a primary slot game having a free spin bonus game, the average expected payback percentage of the gaming system is determined based on: (1) the average expected payback percentage of the primary slot game; and (2) the average expected payback percentage of the free spin bonus game (which is based on the average expected payout of the free spin bonus game and the likelihood of triggering the free spin bonus game). In another example, if the gaming system is configured to operate: (a) a primary poker game, and (b) a primary slot game having a free spin bonus game, the average expected payback percentage of the gaming system is determined based on: (1) the average expected payback percentage of the primary poker game; (2) the average expected payback percentage of the primary slot game; and (3) the average expected payback percentage of the free spin bonus game.

Various gaming systems are also configured with one of a plurality of different volatility levels. The volatility level of a particular gaming system is independent of the average expected payback percentage of that gaming system. Put differently, a plurality of gaming systems having the same average expected payback percentage may each have a different volatility level. For example, a first, a second, and a third gaming system each having an average expected payback percentage of 95% can be configured with a low volatility level, a medium volatility level, and a high volatility level, respectively.

More specifically, for a particular gaming system, the volatility level of that gaming system is determined based on or otherwise depends on the volatility level(s) of the game(s) that that particular gaming system is configured to operate. For instance, if a gaming system is configured to operate only one game, such as a primary poker game, the volatility level of the gaming system is the same as the volatility level of the primary poker game. In another example, if the gaming system is configured to operate a primary slot game having a free spin bonus game, the volatility level of the gaming system is determined based on: (1) the volatility level of the primary slot game; and (2) the volatility level of the free spin bonus game. In another example, if the gaming system is configured to operate: (a) a primary poker game, and (b) a primary slot game having a free spin bonus game, the volatility level of the gaming system is determined based on: (1) the volatility level of the primary poker game; (2) the volatility level of the primary slot game; and (3) the volatility level of the free spin bonus game.

Generally, for a gaming system having a designated average expected payback percentage: (a) when the gaming system is configured with a low volatility level, the gaming system provides frequent winning outcomes and associated awards to players, but many of these awards are relatively small to compensate for the relatively high occurrence of these winning outcomes (to maintain the designated average expected payback percentage); (b) when the gaming system is configured with a high volatility level, the gaming system provides substantially less frequent winning outcomes and associated awards to players, but many of these awards are much larger than those provided when the gaming system is configured with the low volatility level (to maintain the designated average expected payback percentage); and (c) when the gaming system is configured with a medium volatility level, the gaming system provides winning outcomes at a frequency between the frequencies employed when the gaming system is configured with the low and high volatility levels, and the award amounts are between those provided when the gaming system is configured with the low and high volatility levels (to maintain the designated average expected payback percentage).

Tables 1, 2, and 3 below include a example high, medium, and low volatility level paytables, respectively, for an example slot game. In this example, the high, medium, and low volatility level paytables each include the same winning symbol combinations and the same award amounts associated with those winning symbol combinations. Each winning symbol combination has a hit percentage. The hit percentage of a particular winning symbol combination is the probability of that winning symbol combination being generated and displayed for a play of the slot game. The total hit percentage of a paytable is the sum of the hit percentages of the individual winning symbol combinations included in that paytable. Thus, the total hit percentage of a paytable is the probability that at least one of the winning symbol combinations included in that paytable will be generated and displayed for a play of the slot game.

In this example, the total hit percentages of the paytables are different. More particularly, in this example, the high volatility level paytable has the lowest total hit percentage (22.5056%), the low volatility level paytable has the highest total hit percentage (36.1312%), and the medium volatility level paytable has a hit percentage (27.5053%) between the hit percentages of the high and low volatility level paytables. Accordingly, in this example, the gaming system is more likely to generate and display at least one winning symbol combination when the gaming system employs the low volatility level paytable than if either the high volatility level paytable or the medium volatility level paytable had been employed. Additionally, in this example, the gaming system is more likely to generate and display at least one winning symbol combination when the gaming system employs the medium volatility level paytable than if the high volatility level paytable had been employed and is less likely to generate and display at least one winning symbol combination than if the low volatility level paytable had been. Further, in this example, the gaming system is less likely to generate and display at least one winning symbol combination when the gaming system employs the high volatility level paytable than if either the low volatility level paytable or the medium volatility level paytable has been employed.

TABLE 1

Example High Volatility Level Paytable
Example High Volatility Level Paytable

| Winning Symbol Combination | Award (1 Credit Bet) | Hit % | Contribution (Credits) |
|---|---|---|---|
| Seven/Seven/Seven/Seven/Seven | 10,000 | 0.000100% | 0.01000 |
| Triple Bar/Triple Bar/Triple Bar/Triple Bar/Triple Bar | 1,000 | 0.000500% | 0.00500 |
| Double Bar/Double Bar/Double Bar/Double Bar/Double Bar | 100 | 0.005000% | 0.00500 |
| Single Bar/Single Bar/Single Bar | 10 | 7.500000% | 0.75000 |
| Cherry/Cherry/Cherry | 1 | 15.000000% | 0.15000 |
| | | Total Hit % | 22.5056% |
| | | Average Expected Payback % | 92.0000% |

TABLE 2

Example Medium Volatility Level Paytable
Example Medium Volatility Level Paytable

| Winning Symbol Combination | Award (1 Credit Bet) | Hit % | Contribution (Credits) |
|---|---|---|---|
| Seven/Seven/Seven/Seven/Seven | 10,000 | 0.000075% | 0.00750 |
| Triple Bar/Triple Bar/Triple Bar/Triple Bar/Triple Bar | 1,000 | 0.000250% | 0.00250 |
| Double Bar/Double Bar/Double Bar/Double Bar/Double Bar | 100 | 0.005000% | 0.00500 |
| Single Bar/Single Bar/Single Bar | 10 | 7.000000% | 0.70000 |
| Cherry/Cherry/Cherry | 1 | 20.500000% | 0.20500 |
| | | Total Hit % | 27.5053% |
| | | Average Expected Payback % | 92.0000% |

TABLE 3

Example Low Volatility Level Paytable
Example Low Volatility Level Paytable

| Winning Symbol Combination | Award (1 Credit Bet) | Hit % | Contribution (Credits) |
|---|---|---|---|
| Seven/Seven/Seven/Seven/Seven | 10,000 | 0.000050% | 0.00500 |
| Triple Bar/Triple Bar/Triple Bar/Triple Bar/Triple Bar | 1,000 | 0.000100% | 0.00100 |
| Double Bar/Double Bar/Double Bar/Double Bar/Double Bar | 100 | 0.001000% | 0.00100 |
| Single Bar/Single Bar/Single Bar | 10 | 6.130000% | 0.61300 |
| Cherry/Cherry/Cherry | 1 | 30.000000% | 0.30000 |
| | | Total Hit % | 36.1312% |
| | | Average Expected Payback % | 92.0000% |

Certain players prefer low volatility level gaming systems, other players prefer medium volatility level gaming systems, other players prefer high volatility level gaming systems, and other players do not care about the volatility levels of gaming systems.

Certain known gaming systems enable a player to partially affect the volatility level of the gaming system by enabling the player to choose the volatility level of one of the games provided by the gaming system. For example, certain known gaming systems provide a secondary game in the form of free plays of a primary game in which the gaming system enables the player to select from a plurality of different configurations, each of which is associated with a different volatility level, for the free plays. For instance, the gaming system enables the player to select one of: (a) five free plays of the primary game at a 20× multiplier, which corresponds to a high volatility level; and (b) ten free plays of the primary game at a 10× multiplier, which corresponds to a low volatility level. If the player chooses five free plays of the primary game at the 20× multiplier, the player chooses the high volatility level for the secondary game because: (i) the player chooses fewer free plays of the primary game, resulting in a low probability of winning awards; and (ii) the average magnitude of any awards won during those free plays is relatively large. If the player chooses ten free plays of the primary game at the 10× multiplier, the player chooses the lower volatility level because: (i) the player chooses more free plays of the primary game, resulting in a higher probability of winning awards; and (ii) the average magnitude of any awards won during those free plays is relatively small.

Gaming systems typically do not enable players to select or modify the volatility level of a gaming system. Rather, the volatility level of the gaming system is predetermined by the gaming system manufacturer and the casino or other gaming establishment. While some players are able to determine the volatility level of a gaming system by studying the paytables of the gaming system, many players are not able to do so (or not quickly able to do so). Thus, known gaming systems do not directly visually and non-verbally inform players of the volatility levels of the gaming systems. Known gaming systems also do not directly visually and non-verbally inform players of the comparative volatility levels of multiple gaming systems in a casino or other gaming establishment.

It is thus often very difficult for certain players who enjoy playing gaming systems having certain volatility levels (such as low volatility, medium volatility, or high volatility levels) to select gaming systems that match the players' desired level of volatility.

Accordingly, there is a need to solve this problem.

SUMMARY

Various embodiments of the present disclosure generally relate to: (a) a gaming system volatility marker attachable to a gaming system to indicate to a player the volatility level of the gaming system; (b) a gaming system volatility marker attachable to a gaming system to indicate to a player the volatility level of the gaming system compared to one or more other gaming systems; (c) a gaming system that includes a volatility marker that indicates to a player the volatility level of the gaming system; (d) a gaming system that includes a volatility marker that indicates to a player the relative volatility level of the gaming system compared to one or more other gaming systems; (e) a method for causing a gaming system to indicate to a player the volatility level of the gaming system; and (f) a method for causing a gaming system to indicate to a player the relative volatility level of the gaming system compared to one or more other gaming systems. These various embodiments solve the above problems by providing volatility markers for gaming systems, or gaming systems with volatility markers that directly visually and non-verbally inform the players of the volatility level of the gaming system and/or the volatility level of the gaming system compared to one or more other gaming systems.

Additional features and advantages are described herein, and will be apparent from the following Detailed Description and the Figures.

DETAILED DESCRIPTION

Volatility Markers

Figure 1:
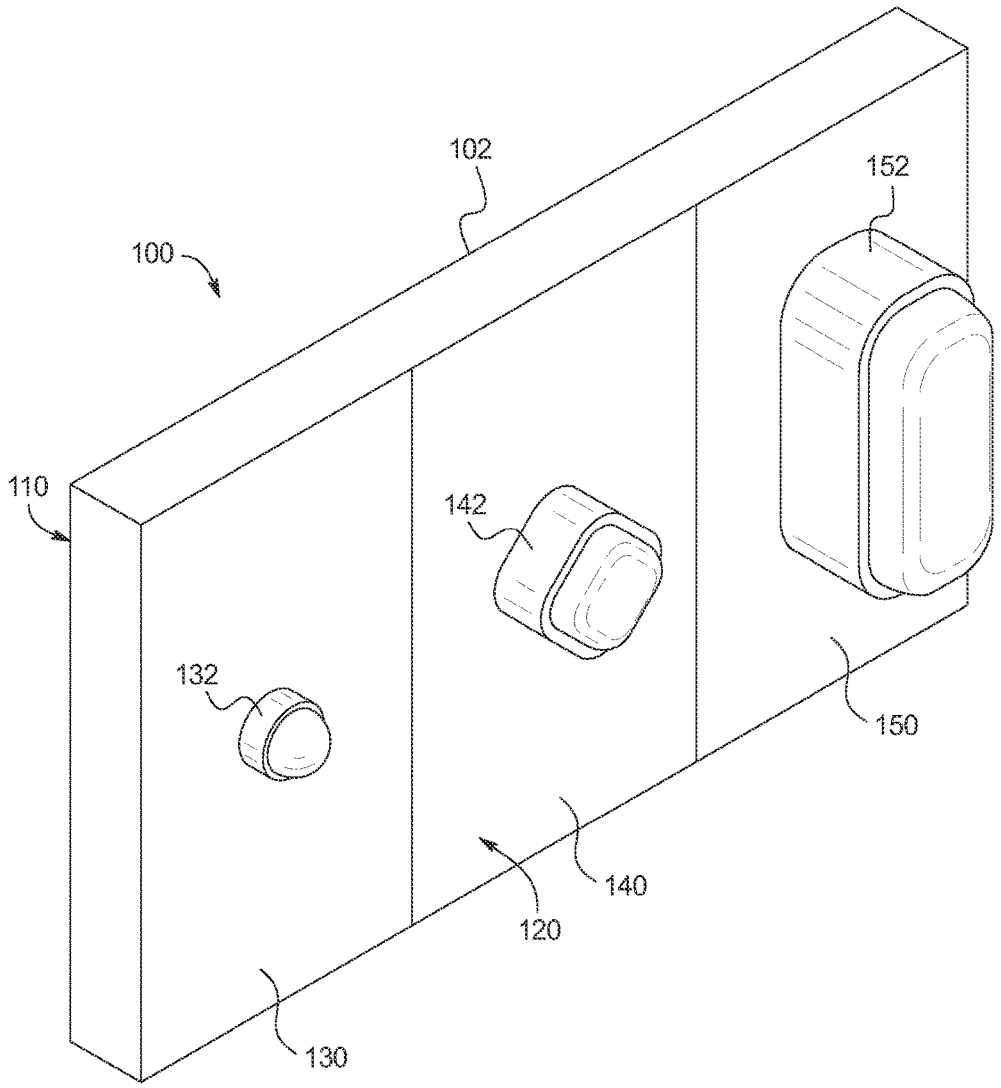
FIG. 1 is a perspective view of a gaming system volatility marker of one example embodiment the present disclosure.
Figure 2:
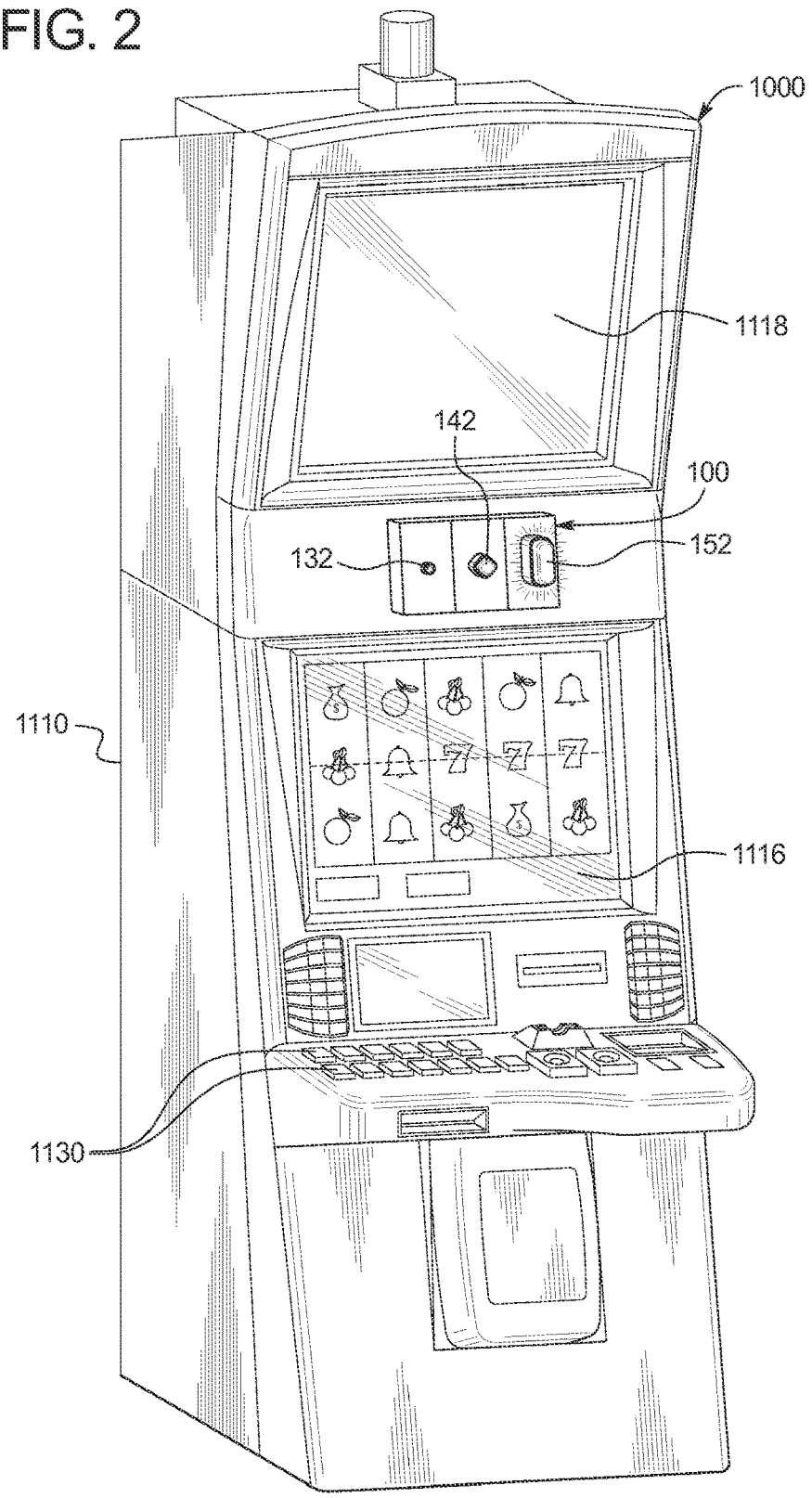
FIG. 2 is a perspective view of the gaming system volatility marker of FIG. 1 attached to a gaming system.

Referring now to the Figures, and specifically to FIGS. 1 and 2, one example embodiment of the gaming system volatility marker of the present disclosure is generally illustrated and indicated by numeral 100. The gaming system volatility marker 100 of this illustrated embodiment generally includes a base or housing 102 having an interior side 110 and an exterior side 120. The interior side 110 of the housing 102 of the gaming system volatility marker 100 is suitably configured to be attached to a gaming system such as gaming system 1000 as generally shown in FIG. 2 and as further described below. The exterior side 120 of the housing 102 of the gaming system volatility marker 100 includes three distinct, different, activatable volatility level indicator sections 130, 140, and 150 that respectively include activatable volatility level indicators 132, 142, and 152. As described below, the three different activatable volatility level indicators 132, 142, and 152 directly visually and non-verbally (e.g., without employing any written letters or numbers) inform the players of the volatility level of the gaming system 1000 and/or the volatility level of the gaming system 1000 compared to the volatility levels of other gaming systems.

More specifically, the first one of the activatable volatility level indicators 132 has: (i) a first round shape indicating a first volatility level, and (ii) a first relatively small size also indicating the first volatility level. The second one of the activatable volatility level indicators 142 has: (i) a second diamond shape indicating a second volatility level, and (ii) a second medium size also indicating the second volatility level. The third one of the activatable volatility level indicators 152 has: (i) a third oval or oblong shape indicating a third volatility level, and (ii) a third relatively large size also indicating the third volatility level. The first shape is different than the second shape and the third shape, and the second shape is different than the third shape. The first size is different than the second size and the third size, and the second size is different than the third size. The first volatility level is different than the second volatility level and the third volatility level, and the second volatility level is different than the third volatility level.

This embodiment of the present disclosure thus provides that the shape and size of each activatable volatility level indicator 132, 142, and 152 corresponds to a respective different volatility level. In this example embodiment: (1) the activatable volatility level indicator 132 has a small size and round shape and corresponds to a low volatility level; (2) the activatable volatility level indicator 142 has a larger size and diamond shape and corresponds to a medium volatility level; and (3) the activatable volatility level indicator 152 has a even larger size and oval or oblong shape and corresponds to a high volatility level. It should be appreciated that the sizes and shapes may vary in accordance with the present disclosure. It should also be appreciated that which sizes and shapes correspond to which volatilities may vary in accordance with the present disclosure. It should further be appreciated that the quantity of activatable volatility level indicators may vary, and is not limited to three.

In this example embodiment, the size of a particular activatable volatility level indicator is the surface area of that activatable volatility level indicator. It should be appreciated that, in other embodiments, the size of a particular activatable volatility level indicator may represent any suitable measurement of that activatable volatility level indicator such as, but not limited to: (a) the radius of that activatable volatility level indicator, (b) the diameter of that activatable volatility level indicator, (c) the length of that activatable volatility level indicator, (d) the width of that activatable volatility level indicator, (e) the height of that activatable volatility level indicator, (f) the depth of that activatable volatility level indicator, and/or (g) the volume of that activatable volatility level indicator.

In this example embodiment, each activatable volatility level indicator 132, 142, and 152 is in the form of or includes an illumination device (such as a light emitting diode ("LED")) that can be individually turned on or illuminated to activate that particular activatable volatility level indicator. In other words: (a) when the volatility level indicator 132 is activated (e.g., the illumination device is turned on), the activated volatility level indicator 132 directly visually and non-verbally informs the player that the gaming system to which the gaming system volatility marker 100 is attached has the low volatility level; (b) when the volatility level indicator 142 is activated (e.g., the illumination device is turned on), the activated volatility level indicator 142 directly visually and non-verbally informs the player that the gaming system to which the gaming system volatility marker 100 is attached has the medium volatility level; and (c) when the volatility level indicator 152 is activated (e.g., the illumination device is turned on), the activated volatility level indicator 152 directly visually and non-verbally informs the player that the gaming system to which the gaming system volatility marker 100 is attached has the high volatility level. The shape and size of the activated volatility level indicator thus assists the player in determining the volatility level of the gaming system as well as the volatility level of the gaming system when compared to other gaming systems. It should be appreciated that the activatable volatility level indicators can be activated in any other suitable manner in accordance with the present disclosure such that players can easily determine which activatable volatility level indicator is activated (and, therefore, the volatility level of the gaming system to which the gaming system volatility marker is attached).

In certain embodiments, such volatility markers include: (a) at least one power source (not shown), such as a battery (not shown) suitably connected to the activatable volatility level indicators; and (b) at least one activation mechanism (not shown) such as one or more switches (not shown) suitably connected to the activatable volatility level indicators and the at least one power source. It should be appreciated that other suitable electrical and/or mechanical components may be employed in such gaming system volatility markers of the present disclosure.

The gaming system volatility marker 100 of this example embodiment of the present disclosure is configured to be attached to a gaming system 1000 as generally shown in FIG. 2. In this illustrated embodiment, the gaming system volatility marker 100 is attached to the gaming system 1000 in a generally central location of the gaming system 1000 such that the gaming system volatility marker 100 is easily and readily seen by players. It should be appreciated that the present disclosure contemplates that the gaming system volatility marker 100 can be attached to a gaming system in any suitable manner and at any suitable location or position as long as it is viewable by players.

In this illustrated embodiment, the gaming system 1000 includes a housing 1110, two display devices 1116 and 1118 supported by the housing 1110, a plurality of input devices 1130 supported by the housing 1110, at least one processor (not shown), and at least one memory device (not shown) that stores a plurality of instructions which, when executed by the at least one processor, cause the at least one processor to operate with the display devices and the input devices to display one or more plays of at least one game. Other example gaming systems are further described below.

In this embodiment, the at least one game of the gaming system 1000 includes at least one primary or base game and can also include at least one secondary or bonus game. As explained above, the volatility level of a gaming system is determined based on or otherwise depends on the volatility level(s) of the game(s) that that particular gaming system is configured to operate. Thus, in this example embodiment, the volatility level of the gaming system 1000 is determined based on the volatility level(s) of the at least one game that the gaming system 1000 is configured to operate. In this embodiment, the at least one game that the gaming system 1000 is configured to operate has the high volatility level and, therefore, the gaming system 1000 has the high volatility level.

Accordingly, as shown in FIG. 2, the activatable volatility level indicator 152 of the gaming system volatility marker 100 is activated (such as by turning on the illumination device) and the activatable volatility level indicators 132 and 142 are not activated, which directly and non-verbally indicates the high volatility level of the gaming system 1000 (and, specifically, the high volatility level of the at least one game that the gaming system 1000 is configured to operate) to which the gaming system volatility marker 100 is attached. Thus, when a player looks at (or walks up to) the gaming system 1000 illustrated in FIG. 2, the size and shape of the activated volatility level indicator 152 directly visually and non-verbally informs the player of the high volatility level of the gaming system 1000. It should be appreciated that additional information can be provided to players regarding the respective volatility levels associated with each of the different activatable volatility level indicators separately from the gaming system volatility markers or in conjunction with the gaming system volatility markers, such as in various alternative example embodiments described below.

Additionally, when a player looks at (or walks up to) the gaming system 1000, the gaming system volatility marker 100 directly visually and non-verbally informs the player of the comparative volatility of that gaming system 1000 to other gaming systems (not shown) in the casino or other gaming establishment (not shown). In this example embodiment: (1) if the activatable volatility level indicator 132 is activated, the player can see that the gaming system 1000 has the low volatility level and that other gaming systems (such as other gaming systems in the casino or other gaming establishment) respectively have the medium volatility level or the high volatility level; (2) if the activatable volatility level indicator 142 is activated, the player can see that the gaming system 1000 has the medium volatility level and that other gaming systems (such as other gaming systems in the casino or other gaming establishment) respectively have the low volatility level or the high volatility level; and (3) if the activatable volatility level indicator 152 is activated, the player can see that the gaming system 1000 has the high volatility level and that other gaming systems (such as other gaming systems in the casino or other gaming establishment) respectively have the medium volatility level or the low volatility level.

Figure 3:
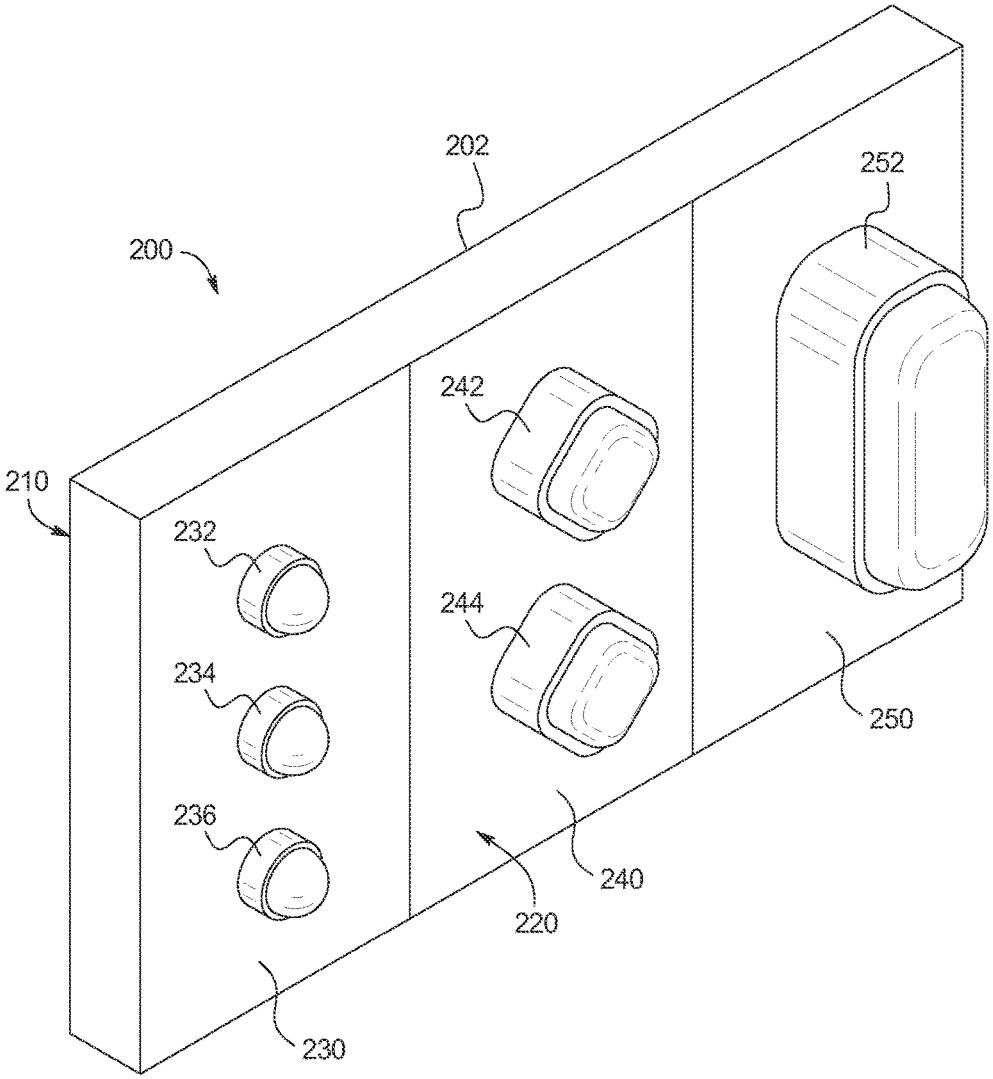
FIG. 3 is a perspective view of a gaming system volatility marker of another example embodiment the present disclosure.
Figure 4:
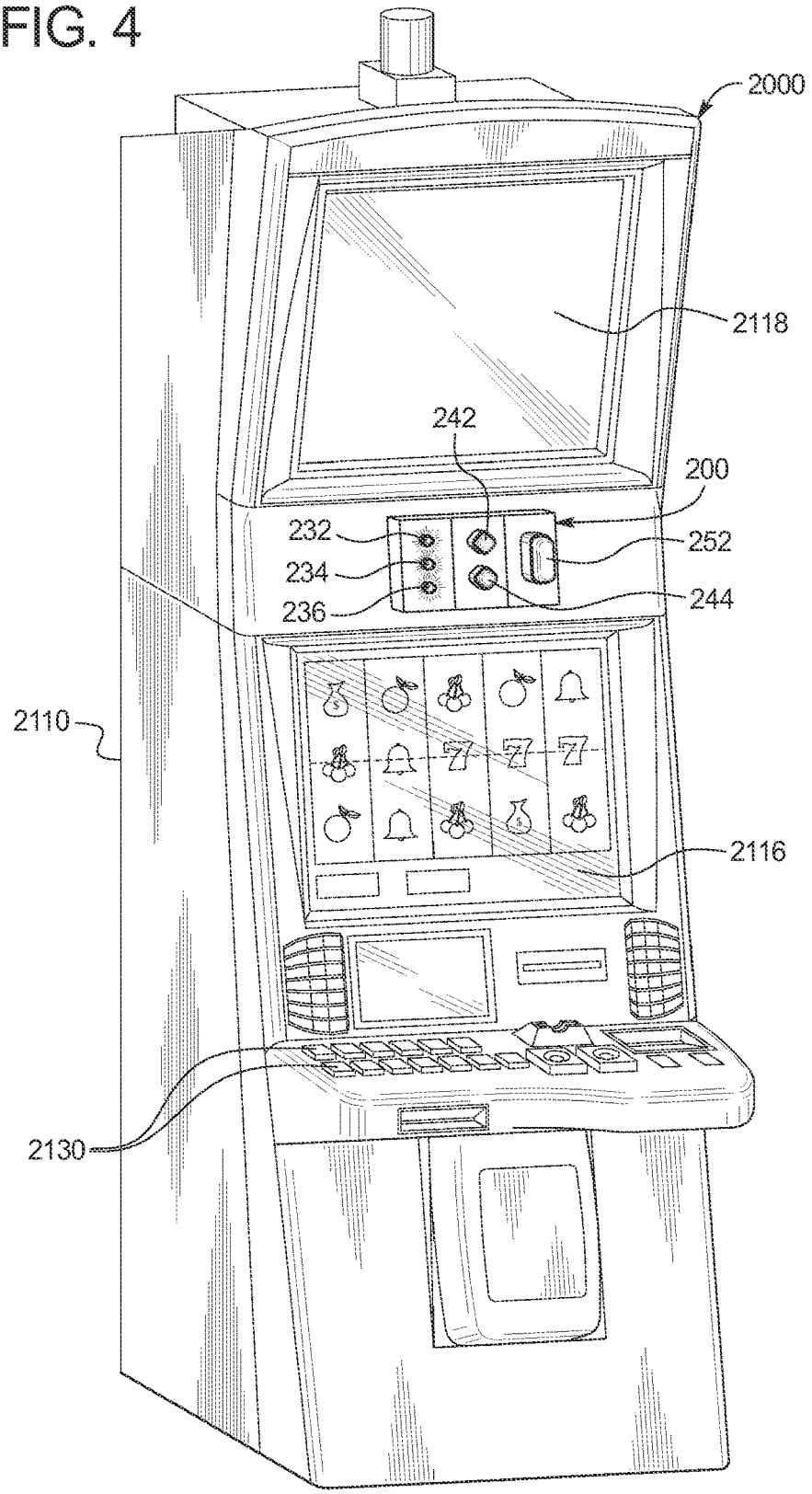
FIG. 4 is a perspective view of the gaming system volatility marker of FIG. 3 attached to a gaming system.

Turning now to FIGS. 3 and 4, another example embodiment of the gaming system volatility marker of the present disclosure is generally illustrated and indicated by numeral 200. The gaming system volatility marker 200 of this illustrated embodiment generally includes a base or housing 202 having an interior side 210 and an exterior side 220. The interior side 210 of the housing 202 of the gaming system volatility marker 200 is suitably configured to be attached to a gaming system such as gaming system 2000 as generally shown in FIG. 4 and as further described below. The exterior side 220 of the housing 202 of the gaming system volatility marker 200 includes three distinct, different, activatable volatility level indicator sections 230, 240, and 250. The activatable volatility level indicator sections each include a set of one or more activatable volatility level indicators. Specifically, in this example embodiment: (a) the activatable volatility level indicator section 230 includes a first set of one or more activatable volatility level indicators including activatable volatility level indicators 232, 234, and 236; (b) the activatable volatility level indicator section 240 includes a second set of one or more activatable volatility level indicators including activatable volatility level indicators 242 and 244; and (c) the activatable volatility level indicator section 250 includes a third set of one or more activatable volatility level indicators including activatable volatility level indicator 252. As described below, the three different sets of activatable volatility level indicators directly visually and non-verbally (e.g., without employing any written letters or numbers) inform the players of the volatility level of the gaming system 1000 and/or the volatility level of the gaming system 1000 compared to volatility levels of other gaming systems.

More specifically, each activatable volatility level indicator 232, 234, and 236 of the first set of activatable volatility level indicators has: (i) a first round shape indicating a first volatility level, and (ii) a first relatively small size also indicating the first volatility level. Each activatable volatility level indicator 242 and 244 of the second set of activatable volatility level indicators has: (i) a second diamond shape indicating a second volatility level, and (ii) a second medium size also indicating the second volatility level. The activatable volatility level indicator 252 of the third set of activatable volatility level indicators has: (i) a third oval or oblong shape indicating a third volatility level, and (ii) a third relatively large size also indicating the third volatility level. The first shape is different than the second shape and the third shape, and the second shape is different than the third shape. The first size is different than the second size and the third size, and the second size is different than the third size. The first volatility level is different than the second volatility level and the third volatility level, and the second volatility level is different than the third volatility level.

This embodiment of the present disclosure thus provides that the shape and size of each activatable volatility level indicator 232, 234, 236, 242, 244, and 252 corresponds to a respective different volatility level. In this example embodiment: (1) each activatable volatility level indicator 232, 234, and 236 has a small size and round shape and corresponds to a low volatility level; (2) each activatable volatility level indicator 242 and 244 has a larger size and diamond shape and corresponds to a medium volatility level; and (3) the activatable volatility level indicator 252 has an even larger size and oval or oblong shape and corresponds to a high volatility level. Additionally, this embodiment of the present disclosure provides that the quantity of activatable volatility level indicators included in a particular set corresponds to a particular volatility level. Different quantities of activatable volatility level indicators correspond to different volatility levels. In this example embodiment: (1) the quantity of the activatable volatility level indicators 232, 234, and 236 in the first set (i.e., a quantity of three) corresponds to the low volatility level; (2) the quantity of activatable volatility level indicators 242 and 244 in the second set (i.e., a quantity of two) corresponds to the medium volatility level; and (3) the quantity of activatable volatility level indicators 252 in the third set (i.e., one) corresponds to the high volatility level. It should be appreciated that: (1) the sizes and shapes may vary in accordance with the present disclosure; (2) which sizes and shapes correspond to which volatilities may vary in accordance with the present disclosure; and (3) the quantities of activatable volatility level indicators may vary in accordance with the present disclosure.

In this example embodiment, each activatable volatility level indicator 232, 234, 234, 236, 242, 244, and 252 is in the form of or includes an illumination device (such as a light emitting diode ("LED")) that can be individually turned on or illuminated or turned on or illuminated in sets to activate that particular activatable volatility level indicator or set of activatable volatility level indicators. In other words: (a) when the volatility level indicators 232, 234, and 236 of the first set are activated, the activated volatility level indicators 232, 234, and 236 of the first set directly visually and non-verbally informs the player that the gaming system to which the gaming system volatility marker 200 is attached has the low volatility; (b) when the volatility level indicators 242 and 244 of the second set are activated, the activated volatility level indicators 242 and 244 of the second set directly visually and non-verbally informs the player that the gaming system to which the gaming system volatility marker 200 is attached has the medium volatility; and (c) when the volatility level indicator 252 of the third set is activated, the activated volatility level indicator 252 of the third set directly visually and non-verbally informs the player that the gaming system to which the gaming system volatility marker 200 is attached has the high volatility. The quantity of activated volatility level indicators in a particular set as well as the shapes and sizes of the activated volatility level indicators of this embodiment thus assist the player in determining the volatility level of the gaming system as well as the volatility level of the gaming system compared to other gaming systems. It should be appreciated that the activatable volatility level indicators can be activated in any other suitable manner in accordance with the present disclosure such that players can easily determine which volatility level indicator(s) are activated.

As stated above, in certain embodiments, such volatility markers includes: (a) at least one power source (not shown) such as a battery (not shown) suitably connected to the activatable volatility level indicators; and (b) at least one activation mechanism (not shown) such as one or more switches (not shown) suitably connected to the activatable volatility level indicators and the at least one power source. It should further be appreciated that other suitable electrical and/or mechanical components may be employed in the gaming system volatility markers of the present disclosure.

The gaming system volatility marker 200 of this embodiment of the present disclosure is configured to be attached to a gaming system 2000 as generally shown in FIG. 4. In this illustrated embodiment, the gaming system volatility marker 200 is attached to the gaming system 2000 in a generally central location of the gaming system 2000 such that the gaming system volatility marker 200 that is easily and readily seen by players. It should be appreciated that the present disclosure contemplates that the gaming system volatility marker 200 can be attached to gaming systems in any suitable manner and at any suitable location or position as long as it is viewable by players.

In this illustrated embodiment, the gaming system 2000 includes a housing 2110, two display devices 2116 and 2116 supported by the housing 2110, a plurality of input devices 2030 supported by the housing 2110, at least one processor (not shown), and at least one memory device (not shown) that stores a plurality of instructions which, when executed by the at least one processor, cause the at least one processor to operate with the display devices and the input devices to display play of at least one game. Other example gaming systems are further described below.

In this embodiment, the at least one game of the gaming system 2000 includes at least one primary or base game and can also include at least one secondary or bonus game. As explained above, the volatility level of a gaming system is determined based on or otherwise depends on the volatility level(s) of the game(s) that that particular gaming system is configured to operate. Thus, in this example embodiment, the volatility level of the gaming system 2000 is determined based on the volatility level(s) of the at least one game that the gaming system 2000 is configured to operate. In this embodiment, the at least one game that the gaming system 2000 is configured to operate has the low volatility level and, therefore, the gaming system 2000 has the low volatility level.

Accordingly, as shown in FIG. 4, the activatable volatility level indicators 232, 234, and 236 of the first set are activated (such as by turning on the corresponding illumination devices) and the activatable volatility level indicators 242, 244, and 252 are not activated, which directly and non-verbally indicates the low volatility level of the gaming system 2000 (and, specifically, the low volatility level of the at least one game that the gaming system 2000 is configured to operate) to which the volatility marker 200 is attached. Thus, when a player looks at (or walks up to) the gaming system 2000 illustrated in FIG. 4, the quantity of activated volatility level indicators as well as the size and shape of each activated volatility level indicator directly visually and non-verbally inform the player of the low volatility level of the gaming system 2000. It should also be appreciated that additional information can be provided to players regarding the respective volatilities associated with each of the different activatable volatility level indicators separately from the gaming system volatility markers or in conjunction with the gaming system volatility markers, such as in various alternative example embodiments described below.

Additionally, when a player looks at (or walks up to) the gaming system 2000, the gaming system volatility marker 200 directly visually and non-verbally informs the player of the comparative volatility level of that gaming system 2000 to other gaming systems (not shown) in the casino or other gaming establishment (not shown). In this example embodiment, (1) if the activatable volatility level indicators 232, 234, and 236 are activated, the player can see that the gaming system 2000 has the low volatility level and that other gaming systems (such as other gaming systems in the casino or other gaming establishment) respectively have the medium volatility level or the high volatility level; (2) if the activatable volatility level indicators 242 and 244 are activated, the player can see that the gaming system 2000 has the medium volatility level and that other gaming systems (such as other gaming systems in the casino or other gaming establishment) respectively have the low volatility level and the high volatility level; and (3) if the activatable volatility level indicator 252 is activated, the player can see that the gaming system 2000 has the high volatility level and that other gaming systems (such as other gaming systems in the casino or gaming establishment) respectively have the medium volatility level and the low volatility level.

Figure 5:
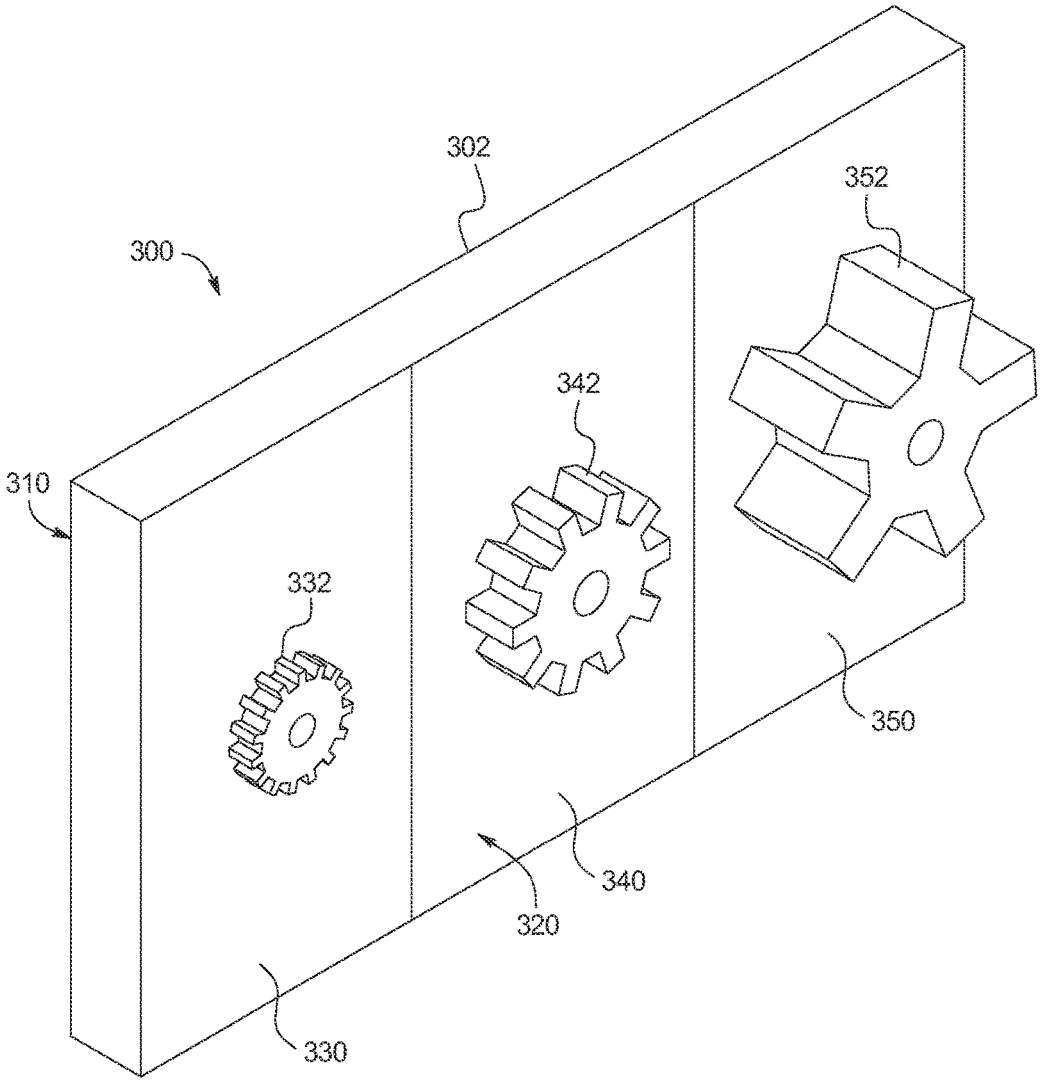
FIG. 5 is a perspective view of a gaming system volatility marker of another example embodiment the present disclosure.
Figure 6:
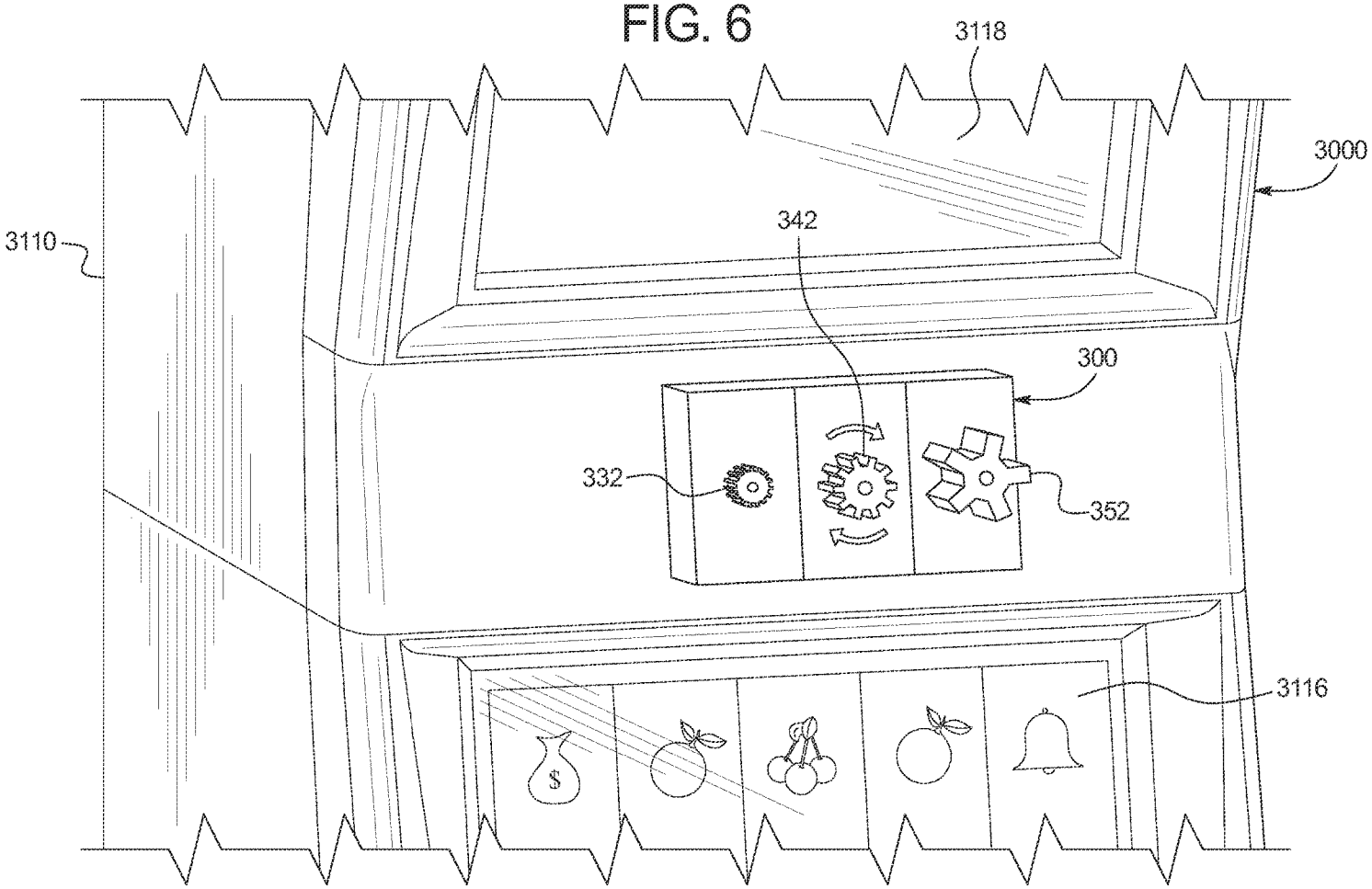
FIG. 6 is a perspective view of the gaming system volatility marker of FIG. 5 attached to a gaming system.

Turning now to FIGS. 5 and 6, another example embodiment of the gaming system volatility marker of the present disclosure is generally illustrated and indicated by numeral 300. The gaming system volatility marker 300 of this illustrated embodiment generally includes a base or housing 302 having an interior side 310 and an exterior side 320. The interior side 310 of the housing 302 of the gaming system volatility marker 300 is suitably configured to be attached to a gaming system such as gaming system 3000 as generally shown in FIG. 6 and as further described below. The exterior side 320 of the housing 302 of the gaming system volatility marker 300 includes three distinct, different, activatable volatility level indicator sections 330, 340, and 350 that respectively include activatable volatility level indicators 332, 342, and 352. As described below, the three different activatable volatility level indicators 332, 342, and 352 directly visually and non-verbally (e.g., without employing any written letters or numbers) inform the players of the volatility of the gaming system 3000 and/or the volatility levels of the gaming system 3000 compared to volatility levels of other gaming systems.

More specifically, the first one of the activatable volatility level indicators 332 has: (i) a first gear shape (including a shape and quantity of subcomponents or teeth) indicating a first volatility level, and (ii) a first relatively small size also indicating the first volatility level. The second one of the activatable volatility level indicators 242 has: (i) a second gear shape (including a shape and quantity of subcomponents or teeth) indicating a second volatility level, and (ii) a second medium size also indicating the second volatility level. The third one of the activatable volatility level indicators 352 has: (i) a third gear shape (including a shape and quantity of subcomponents or teeth) indicating a third volatility level, and (ii) a third relatively large size also indicating the third volatility level. The first gear is different than the second gear and the third gear (in shape, size of teeth, and quantity of teeth), and the second gear is different than the third gear (in shape, size of teeth, and quantity of teeth). Additionally, the first gear size is different than the second gear size and the third gear size, and the second gear size is different than the third gear size. The first volatility level is different than the second volatility level and the third volatility level, and the second volatility level is different than the third volatility level.

This embodiment of the present disclosure thus provides that the shape (including the size of teeth and quantity of teeth) and size of each activatable volatility level indicator 232, 242, and 252 corresponds to a respective different volatility level. In this example embodiment: (1) the activatable volatility level indicator 232 corresponds to a low volatility level; (2) the activatable volatility level indicator 242 corresponds to a medium volatility level; and (3) the activatable volatility level indicator 152 corresponds to a high volatility level. The shapes and sizes of the activatable volatility level indicators thus assist the player in determining the volatility level of the gaming system as well as the volatility level of the gaming system when compared to other gaming systems. It should be appreciated that the sizes and shapes of the gears may vary in accordance with the present disclosure. It should also be appreciated that which sizes and shapes of the gears correspond to which volatility levels may vary in accordance with the present disclosure. It should further be appreciated from this example that any suitable objects or configurations may be employed to convey the volatility level information to players.

In this example embodiment, each activatable volatility level indicator 332, 342, and 352 is independently movable, such as rotatable, and can be individually turned on or moved or rotated to activate that particular activatable volatility level indicator. In other words: (a) when the volatility level indicator 332 is activated (e.g., by rotating), the activated volatility level indicator 332 directly visually and non-verbally informs the player that the gaming system to which the gaming system volatility marker 300 is attached has the low volatility level; (b) when the volatility level indicator 342 is activated (e.g., by rotating), the activated volatility level indicator 342 directly visually and non-verbally informs the player that the gaming system to which the gaming system volatility marker 300 is attached has the medium volatility level; and (c) when the volatility level indicator 352 is activated (e.g., by rotating), the activated volatility level indicator 352 directly visually and non-verbally informs the player that the gaming system to which the gaming system volatility marker 300 is attached has the high volatility level. The shape (including the size of the teeth and quantity of teeth) and size of the activated volatility level indicator thus assists the player in understanding the volatility level of the gaming system as well as the volatility level of the gaming system when compared to other gaming systems.

In certain embodiments, such volatility markers include at least one power source (not shown) such as a battery (not shown) suitably connected to the activatable volatility level indicators and at least one activation mechanism (not shown) such as one or more switches (not shown) suitably connected to the activatable volatility level indicators and the at least one power source. It should further be appreciated that other suitable electrical and/or mechanical components may be employed in the gaming system volatility markers of the present disclosure.

The gaming system volatility marker 300 of this embodiment of the present disclosure is configured to be attached to a gaming system 3000 as generally shown in FIG. 6. In this illustrated embodiment, the gaming system volatility marker 300 is attached to the gaming system 3000 in a generally central location of the gaming system 3000 such that the gaming system volatility marker 300 is easily and readily seen by players. It should be appreciated that the present disclosure contemplates that the gaming system volatility marker 300 can be attached to a gaming system in any suitable manner and at any suitable location or position as long as it is viewable by players.

In this illustrated embodiment, the gaming system 3000 includes a housing 3110, two display devices 3116 and 3118 supported by the housing 3110, a plurality of input devices (not shown) supported by the housing 3110, at least one processor (not shown), and at least one memory device (not shown) that stores a plurality of instructions which, when executed by the at least one processor, cause the at least one processor to operate with the display devices and the input devices to display one or more plays of at least one game. Other example gaming systems are further described below.

In this embodiment, the at least one game of the gaming system 3000 includes at least one primary or base game and can also include at least one secondary or bonus game. As explained above, the volatility level of a gaming system is determined based on or otherwise depends on the volatility level(s) of the game(s) that that particular gaming system is configured to operate. Thus, in this example embodiment, the volatility level of the gaming system 3000 is determined based on the volatility level(s) of the at least one game that the gaming system 3000 is configured to operate. In this embodiment, the at least one game that the gaming system 3000 is configured to operate has the medium volatility level and, therefore, the gaming system 3000 has the medium volatility level.

Accordingly, as shown in FIG. 6, the activatable volatility level indicator 342 of the gaming system volatility marker 300 is activated (such as by rotating) and the activatable volatility level indicators 332 and 352 are not activated, which directly and non-verbally indicates the medium volatility level of the gaming system 3000 (and, specifically, the medium volatility level of the at least one game that the gaming system 3000 is configured to operate). Thus, when a player looks at (or walks up to) the gaming system 3000 illustrated in FIG. 6, the size and shape of the activated volatility level indicator 342 directly visually and non-verbally informs the player of the medium volatility level of the gaming system 3000. It should be appreciated that additional information can be provided to players regarding the respective volatility levels associated with each of the different activatable volatility level indicators separately from the gaming system volatility markers or in conjunction with the gaming system volatility markers, such as in various alternative example embodiments described below.

Additionally, when a player looks at (or walks up to) the gaming system 3000, the gaming system volatility marker 300 directly visually and non-verbally informs the player of the comparative volatility level of that gaming system 3000 to other gaming systems (not shown) in the casino or other gaming establishment (not shown). In this example embodiment: (1) if the activatable volatility level indicator 332 is activated, the player can see that the gaming system 3000 has the low volatility level and that other gaming systems (such as other gaming systems in the other casino or gaming establishment) respectively have the medium volatility level or the high volatility level; (2) if the activatable volatility level indicator 342 is activated, the player can see that the gaming system 3000 has the medium volatility level and that other gaming systems (such as other gaming systems in the casino or other gaming establishment) respectively have the low volatility level or the high volatility level; and (3) if the activatable volatility level indicator 352 is activated, the player can see that the gaming system 3000 has the high volatility level and that other gaming systems (such as other gaming systems in the casino or other gaming establishment) respectively have the medium volatility level or the low volatility level.

Figure 7:
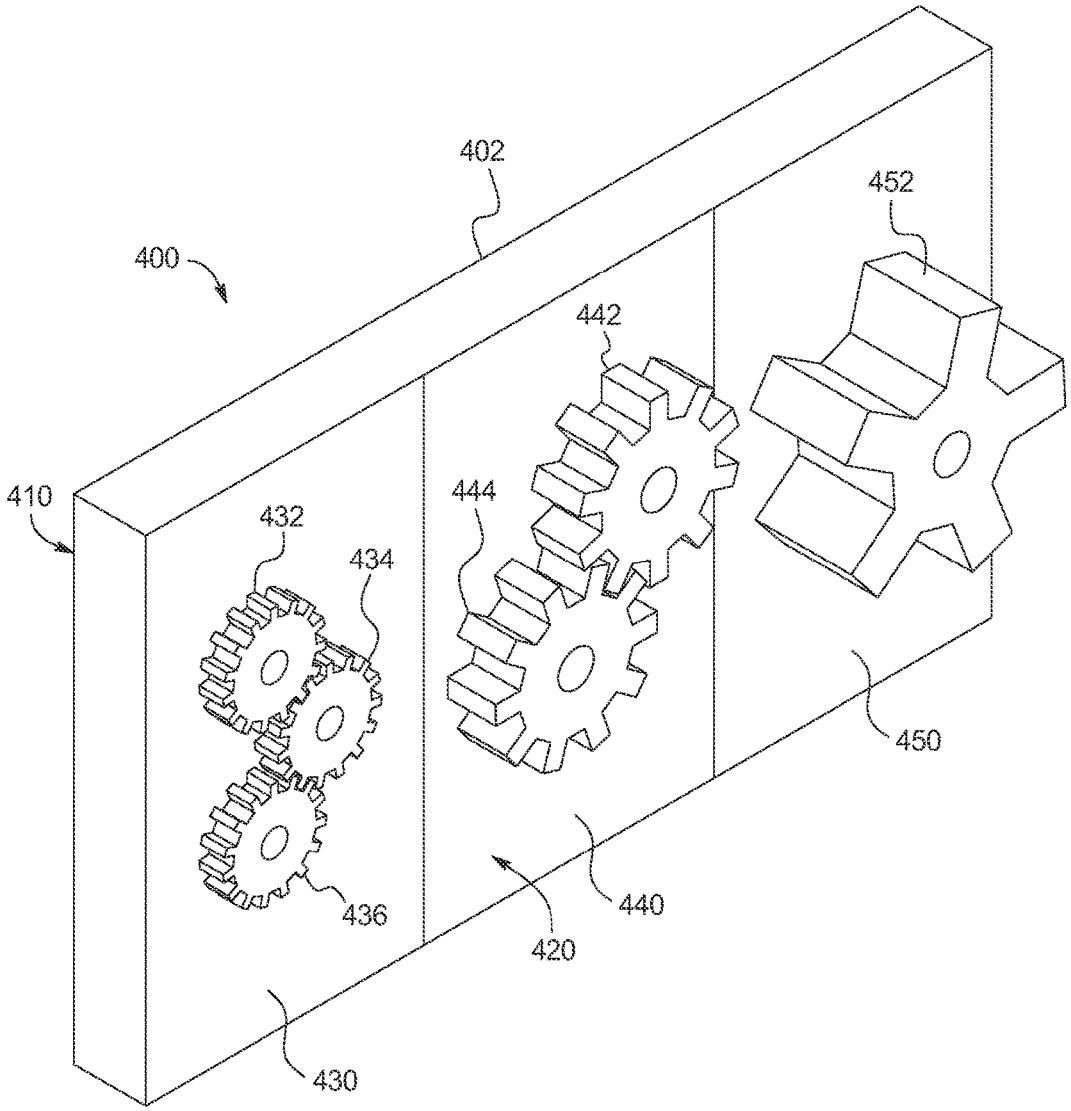
FIG. 7 is a perspective view of a gaming system volatility marker of another example embodiment the present disclosure.
Figure 8:
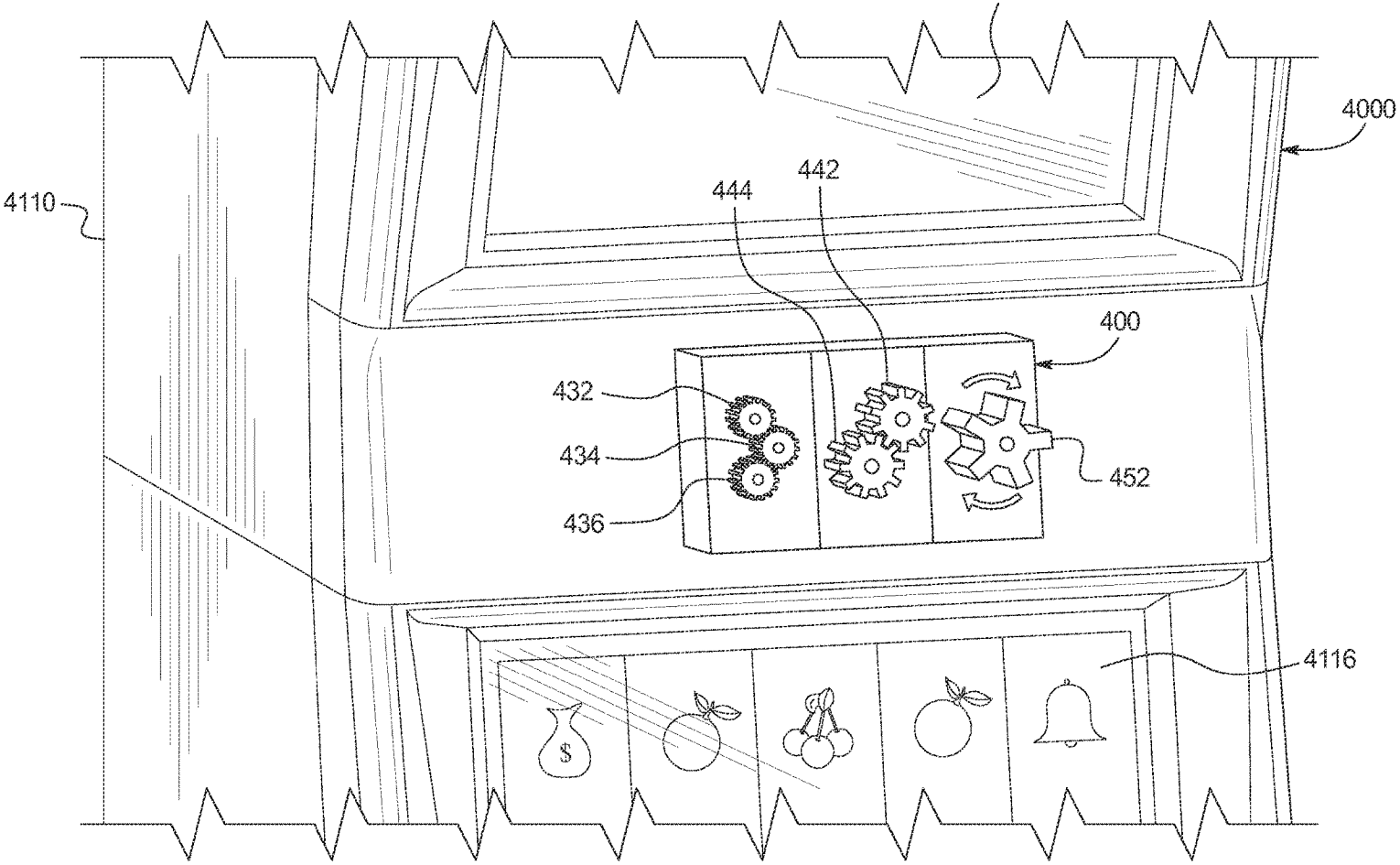
FIG. 8 is a perspective view of the gaming system volatility marker of FIG. 7 attached to a gaming system.
Figure 9A:
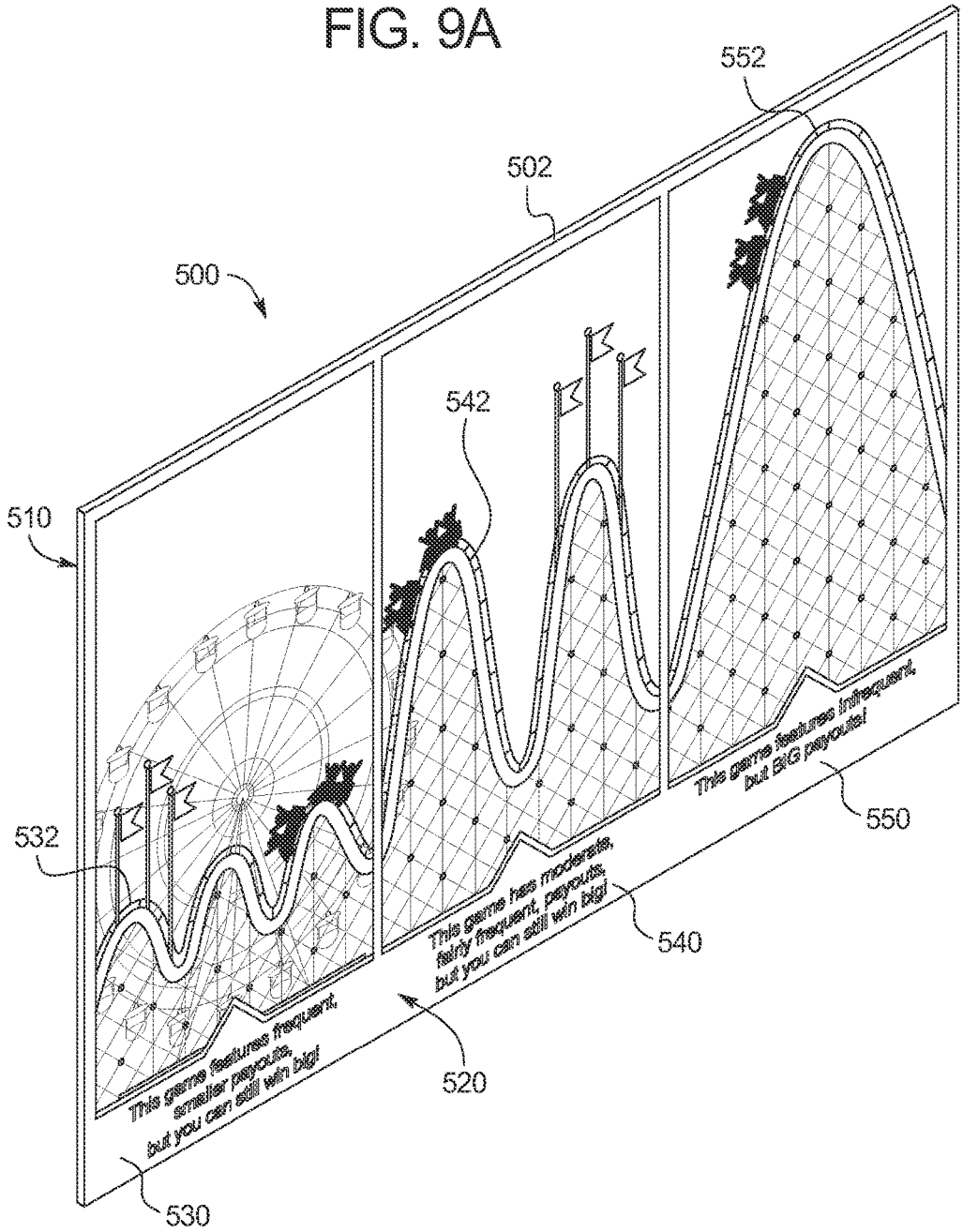
FIG. 9A is a perspective view of a gaming system volatility marker of another example embodiment the present disclosure.
Figure 9B:
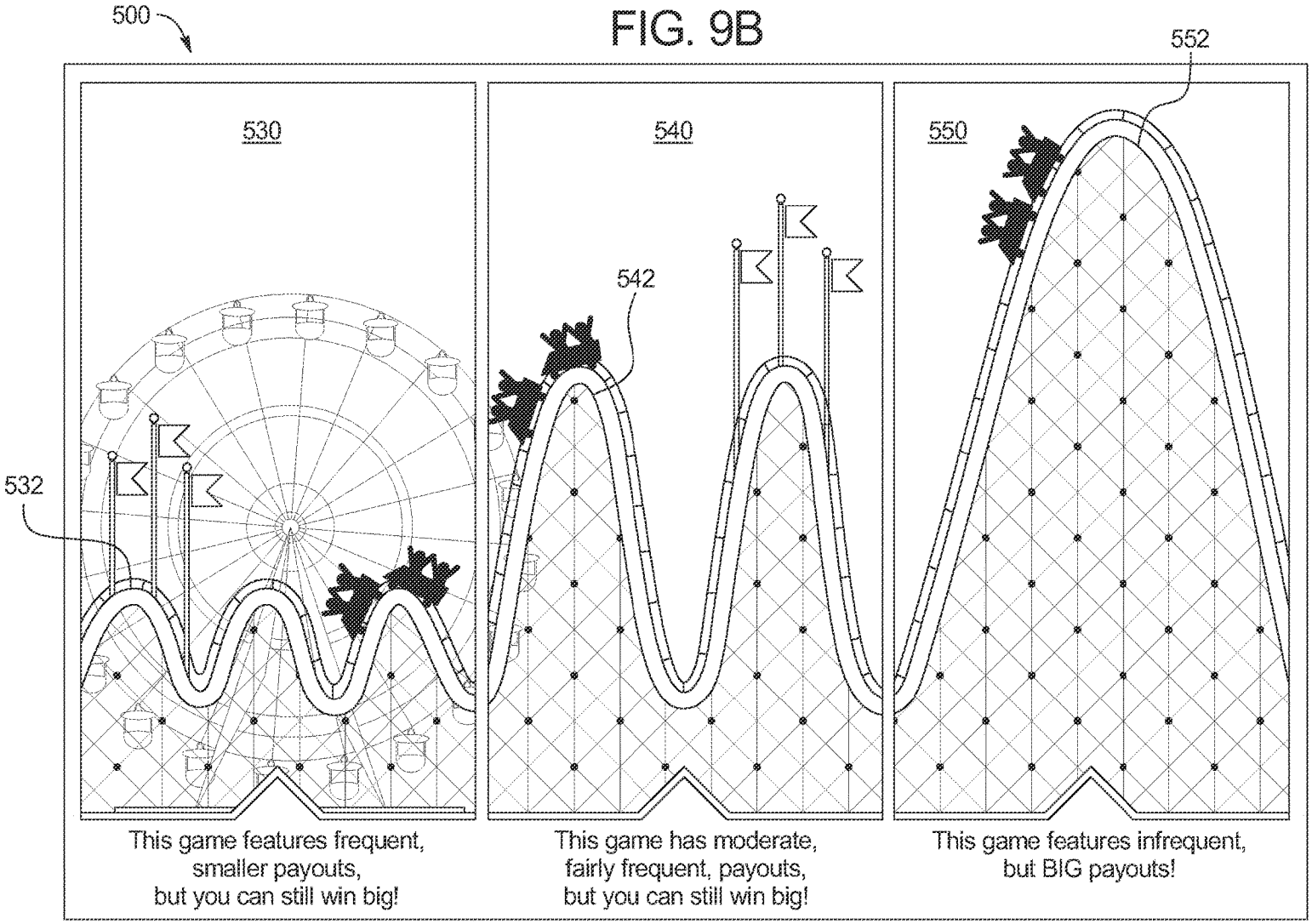
FIG. 9B is a front view of the gaming system volatility marker of FIG. 9A.

Turning now to FIGS. 7 and 8, another example embodiment of the gaming system volatility marker of the present disclosure is generally illustrated and indicated by numeral 400. The gaming system volatility marker 400 of this illustrated embodiment generally includes a base or housing 402 having an interior side 410 and an exterior side 420. The interior side 410 of the housing 402 of the gaming system volatility marker 400 is suitably configured to be attached to a gaming system such as gaming system 4000 as generally shown in FIG. 4 and as further described below. The exterior side 420 of the housing 402 of the gaming system volatility marker 400 includes three distinct different activatable volatility level indicator sections 430, 440, and 450. The activatable volatility level indicator sections each include a set of one or more activatable volatility level indicators. Specifically, in this example embodiment: (a) the activatable volatility level indicator section 430 includes a first set of one or more activatable volatility level indicators including activatable volatility level indicators 432, 434, and 436; (b) the activatable volatility level indicator section 440 includes a second set of one or more activatable volatility level indicators including activatable volatility level indicators 442 and 444; and (c) the activatable volatility level indicator section 450 includes a third set of one or more activatable volatility level indicators including activatable volatility level indicator 452. As described below, the three different sets of activatable volatility level indicators directly visually and non-verbally (e.g., without employing any written letters or numbers) inform the players of the volatility level of the gaming system 4000 and/or the volatility level of the gaming system 4000 compared to volatility levels of other gaming systems.

More specifically, each activatable volatility level indicator 432, 434, and 436 of the first set of the activatable volatility level indicators has: (i) a first gear shape (including a shape and quantity of subcomponents or teeth) indicating a first volatility level, and (ii) a first relatively small size also indicating the first volatility level. Each activatable volatility level indicator 442 and 444 of the second set of activatable volatility level indicators has: (i) a second gear shape (including a shape and quantity of subcomponents or teeth) indicating a second volatility level, and (ii) a second medium size also indicating the second volatility level. The activatable volatility level indicator 452 of the third set of activatable volatility level indicators has: (i) a third gear shape (including a shape and quantity of subcomponents or teeth) indicating a third volatility level, and (ii) a third relatively large size also indicating the third volatility level. The first gear shape is different than the second gear shape and the third gear shape, and the second gear shape is different than the third gear shape. The first size is different than the second size and the third size, and the second size is different than the third size. The first volatility level is different than the second volatility level and the third volatility level, and the second volatility level is different than the third volatility level.

This embodiment of the present disclosure thus provides that the shape (including the shape of the teeth and quantity of the teeth) and size of each activatable volatility level indicator 432, 434, 436, 442, 444, and 452 corresponds to a respective different volatility level. In this example embodiment, (1) the activatable volatility level indicators 432, 434, and 436 of the first set correspond to a low volatility level; (2) the activatable volatility level indicators 442 and 444 of the second set correspond to a medium volatility level; and (3) the activatable volatility level indicator 452 of the third set corresponds to a high volatility level. Additionally, this embodiment of the present disclosure provides that the quantity of activatable volatility level indicators included in a particular set corresponds to a particular volatility level. Different quantities of activatable volatility level indicators correspond to different volatility levels. In this example embodiment: (1) the quantity of the activatable volatility level indicators 432, 434, and 436 of the first set (i.e., a quantity of three) (and the quantity of teeth of those activatable volatility level indicators) also corresponds to the low volatility level; (2) the quantity of activatable volatility level indicators 442 and 444 of the second set (i.e., a quantity of two) (and the quantity of teeth of those activatable volatility level indicators) correspond to the medium volatility level; and (3) the quantity of activatable volatility level indicators 452 of the third set (i.e., a quantity of one) (and the quantity of teeth of those activatable volatility level indicators) correspond to the high volatility level.

The quantity of the activatable volatility level indicators in a particular set as well as the shapes and sizes of the activatable volatility level indicators of this embodiment thus assist the player in determining the volatility level of the gaming system as well as the volatility level of the gaming system compared to other gaming systems. It should be appreciated that: (1) the sizes and shapes may vary in accordance with the present disclosure; (2) which sizes and shapes correspond to which volatilities may vary in accordance with the present disclosure; (3) the quantities of activatable volatility level indicators included in the sets may vary in accordance with the present disclosure; and (4) the quantities of subcomponents (such as teeth) of the activatable volatility level indicators may vary in accordance with the present disclosure.

In this example embodiment, each activatable volatility level indicator 432, 434, 434, 436, 442, 444, and 452 is movable, such as rotatable, and can be turned on in sets to activate that set of activatable volatility level indicators. In other words: (a) when the volatility level indicators 432, 434, and 436 are activated (e.g., by rotating), those activated volatility level indicators directly visually and non-verbally inform the player that the gaming system to which the gaming system volatility marker 400 is attached has the low volatility level; (b) when the volatility level indicators 442 and 444 are activated (e.g., by rotating), those activated volatility level indicators directly visually and non-verbally inform the player that the gaming system to which the gaming system volatility marker 400 is attached has the medium volatility level; and (c) when the volatility level indicator 452 is activated (e.g., by rotating), that activated volatility level indicator directly visually and non-verbally informs the player that the gaming system to which the gaming system volatility marker 400 is attached has the high volatility level. The quantity of activated volatility level indicators as well as the shape and size of each activated volatility level indicator as well as the quantity of subcomponents (such as the teeth of each gear) of each activated volatility level indicator of this embodiment thus assist the player in determining the volatility level of the gaming system as well as the volatility level of the gaming system when compared to other gaming systems. In this example embodiment, the gears 432, 434, and 436 of the first set and the gears 442 and 444 of the second set are suitably mated, meshed or interconnected. It should be appreciated that in alternative embodiments, one or more of these sets can have the gears independently positioned.

As stated above, in certain embodiments, such volatility markers includes: (a) at least one power source (not shown) such as a battery (not shown) suitably connected to the activatable volatility level indicators; and (b) at least one activation mechanism (not shown) such as one or more switches (not shown) suitably connected to the activatable volatility level indicators and the at least one power source. It should further be appreciated that other suitable electrical and/or mechanical components may be employed in the gaming system volatility markers of the present disclosure.

The gaming system volatility marker 400 of this embodiment of the present disclosure is configured to be attached to a gaming system 4000 as generally shown in FIG. 8. In this illustrated embodiment, the gaming system volatility marker 400 is attached to the gaming system 4000 in a generally central location of the gaming system 4000 such that the gaming system volatility marker 400 that is easily and readily seen by players. It should be appreciated that the present disclosure contemplates that the gaming system volatility marker 400 can be attached to gaming systems in any suitable manner and at any suitable location or position as long as it is viewable by players.

In this illustrated embodiment, the gaming system 4000 includes a housing 4110, two display devices 4116 and 4116 supported by the housing 4110, a plurality of input devices (not shown) supported by the housing 4110, at least one processor (not shown), and at least one memory device (not shown) that stores a plurality of instructions which, when executed by the at least one processor, cause the at least one processor to operate with the display devices and the input devices to display play of at least one game. Other example gaming systems are further described below.

In this embodiment, the at least one game of the gaming system 4000 includes at least one primary or base game and can also include at least one secondary or bonus game. As explained above, the volatility level of a gaming system is determined based on or otherwise depends on the volatility level(s) of the game(s) that that particular gaming system is configured to operate. Thus, in this example embodiment, the volatility level of the gaming system 4000 is determined based on the volatility level(s) of the at least one game that the gaming system 4000 is configured to operate. In this embodiment, the at least one game that the gaming system 4000 is configured to operate has the high volatility level and, therefore, the gaming system 4000 has the high volatility level.

Accordingly, as shown in FIG. 8, the activatable volatility level indicator 452 of the third set is activated (such as by rotating) and the activatable volatility level indicators 432, 434, 436, 442, and 444 are not activated, which directly and non-verbally indicates the high volatility level of the gaming system 4000 (and, specifically, the high volatility level of the at least one game that the gaming system 4000 is configured to operate) to which the volatility marker 400 is attached. Thus, when a player looks at (or walks up to) the gaming system 4000 illustrated in FIG. 8, the quantity of activated volatility level indicators as well as the size and shape of each activated volatility level indicator as well as the quantity and size of the subcomponents or teeth of each activated volatility level indicator directly visually and non-verbally informs the player of the high volatility level of the gaming system 4000. It should also be appreciated that additional information can be provided to players regarding the respective volatilities associated with each of the different activatable volatility level indicators separately from the gaming system volatility markers or in conjunction with the gaming system volatility markers, such as in various alternative example embodiments described below.

Additionally, when a player looks at (or walks up to) the gaming system 4000, the gaming system volatility marker 400 directly visually and non-verbally informs the player of the comparative volatility level of that gaming system 4000 to other gaming systems (not shown) in the casino or other gaming establishment (not shown). In this example embodiment, (1) if the activatable volatility level indicators 432, 434, and 436 are activated, the player can see that the gaming system 4000 has the low volatility level and that other gaming systems (such as other gaming systems in the casino or other gaming establishment) respectively have the medium volatility level or the high volatility level; (2) if the activatable volatility level indicators 442 and 444 are activated, the player can see that the gaming system 5000 has the medium volatility level and that other gaming systems (such as other gaming systems in the casino or other gaming establishment) respectively have the low volatility level and the high volatility level; and (3) if the activatable volatility level indicator 452 is activated, the player can see that the gaming system 4000 has the high volatility level and that other gaming systems (such as other gaming systems in the casino or gaming establishment) respectively have the medium volatility level and the low volatility level.

Figure 10A:
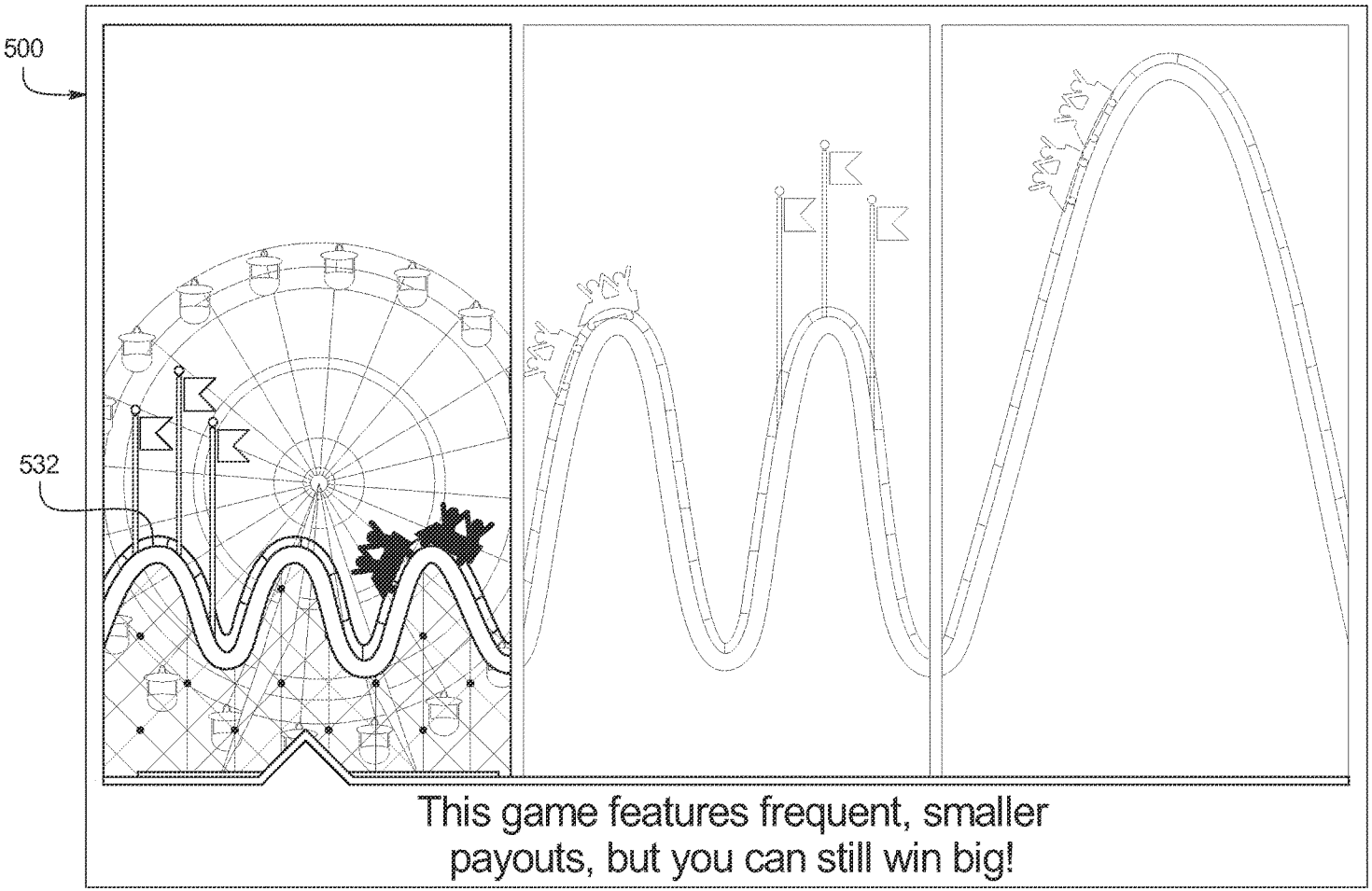
FIG. 10A is a front view of the gaming system volatility marker of FIG. 9A with the low volatility level indicator activated.
Figure 10B:
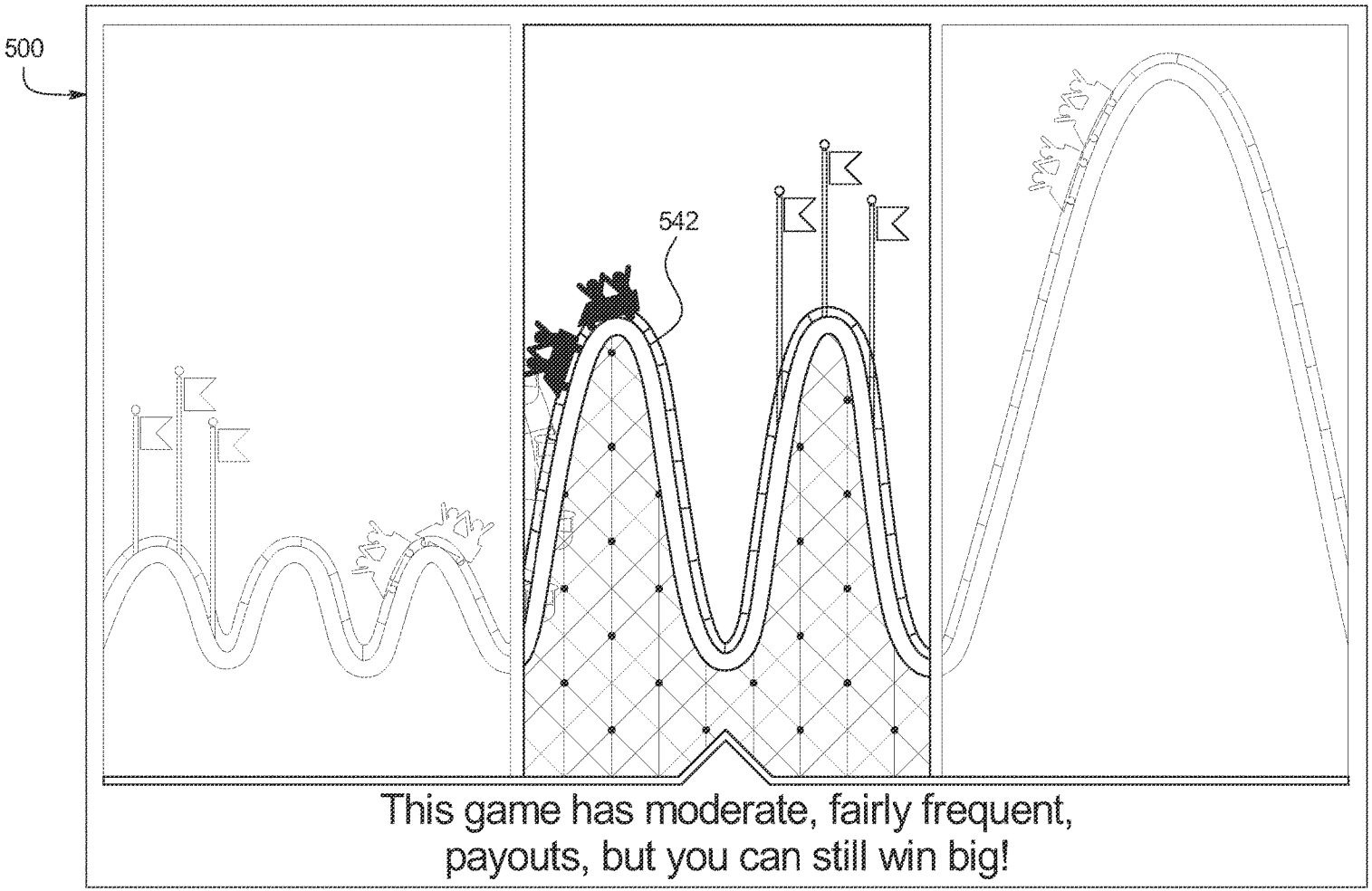
FIG. 10B is a front view of the gaming system volatility marker of FIG. 9A with the medium volatility level indicator activated.
Figure 10C:
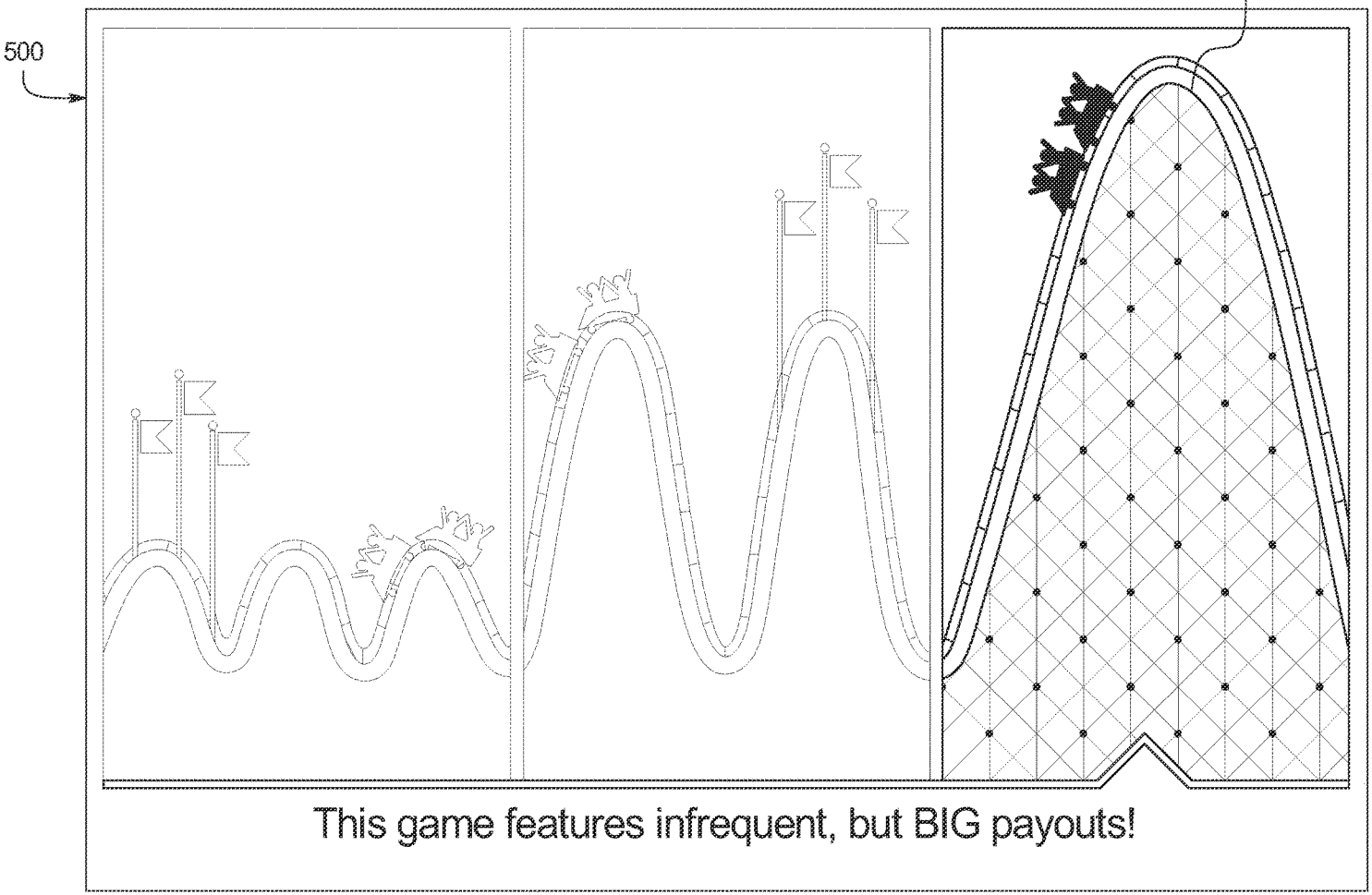
FIG. 10C is a front view of the gaming system volatility marker of FIG. 9A with the high volatility level indicator activated.
Figure 11A:
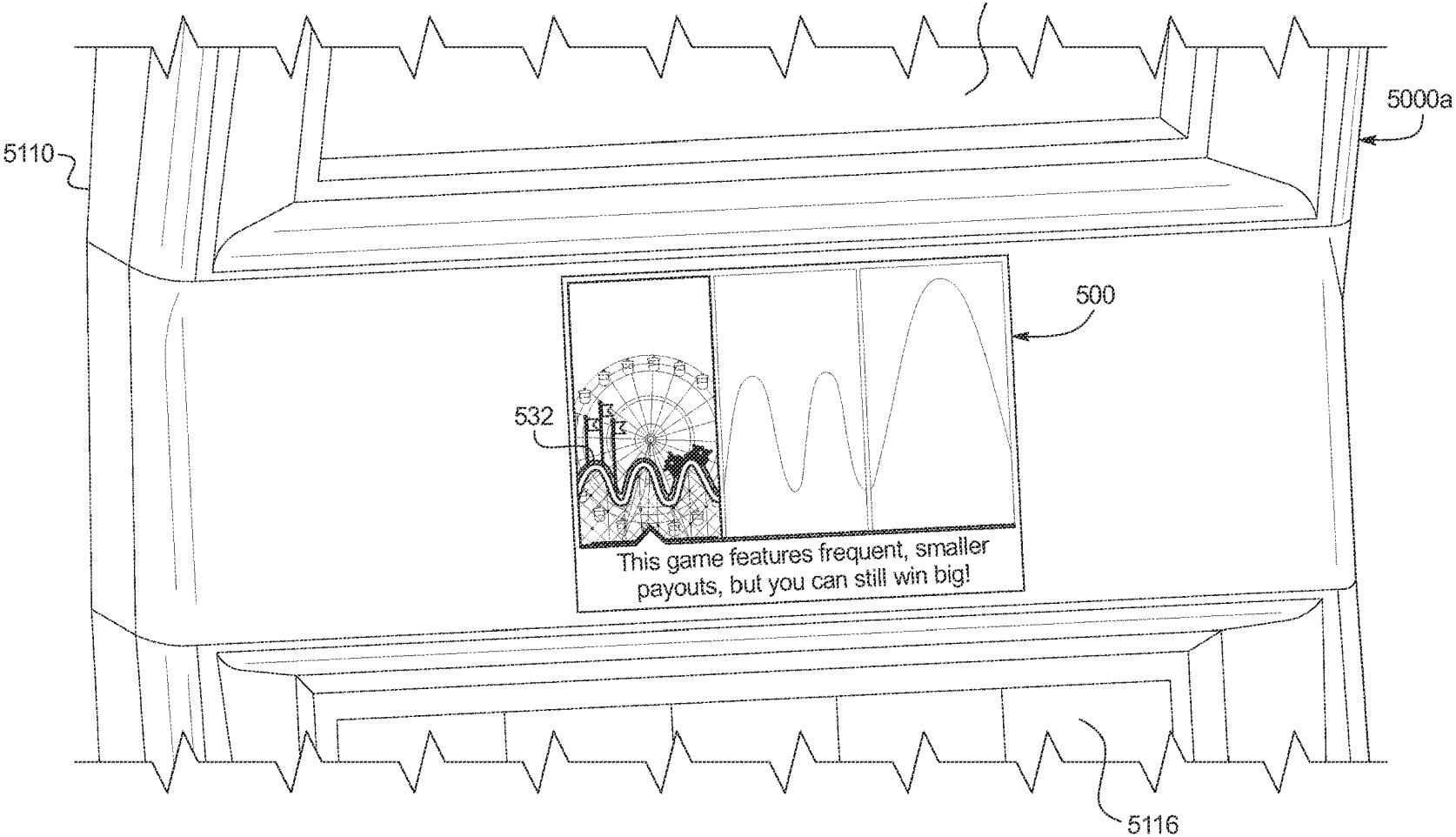
FIG. 11A is a perspective view of the gaming system volatility marker of FIG. 9A with the low volatility level indicator activated and attached to a gaming system (shown in fragmentary).
Figure 11B:
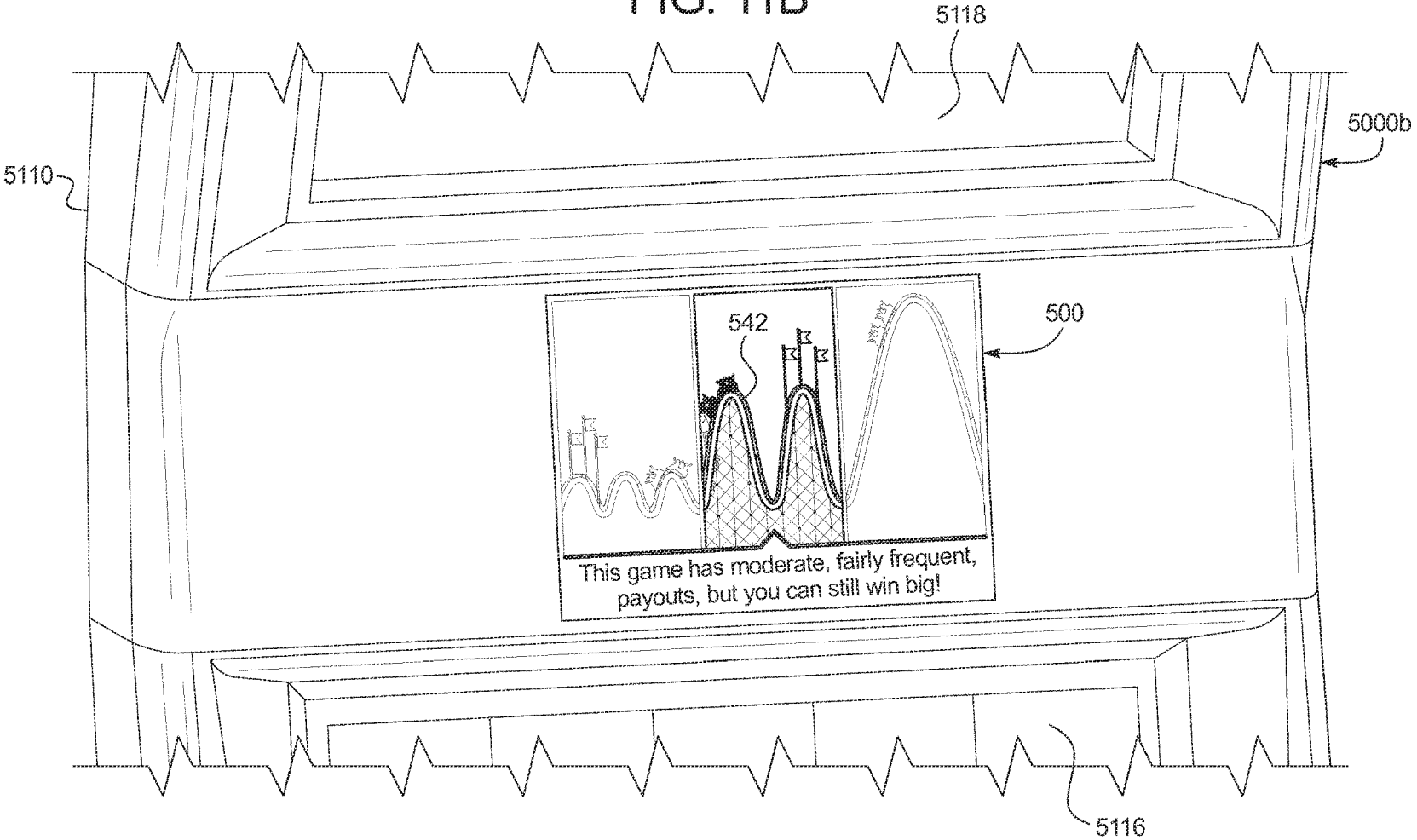
FIG. 11B is a perspective view of the gaming system volatility marker of FIG. 9A with the medium volatility level indicator activated and attached to a gaming system (shown in fragmentary).
Figure 11C:
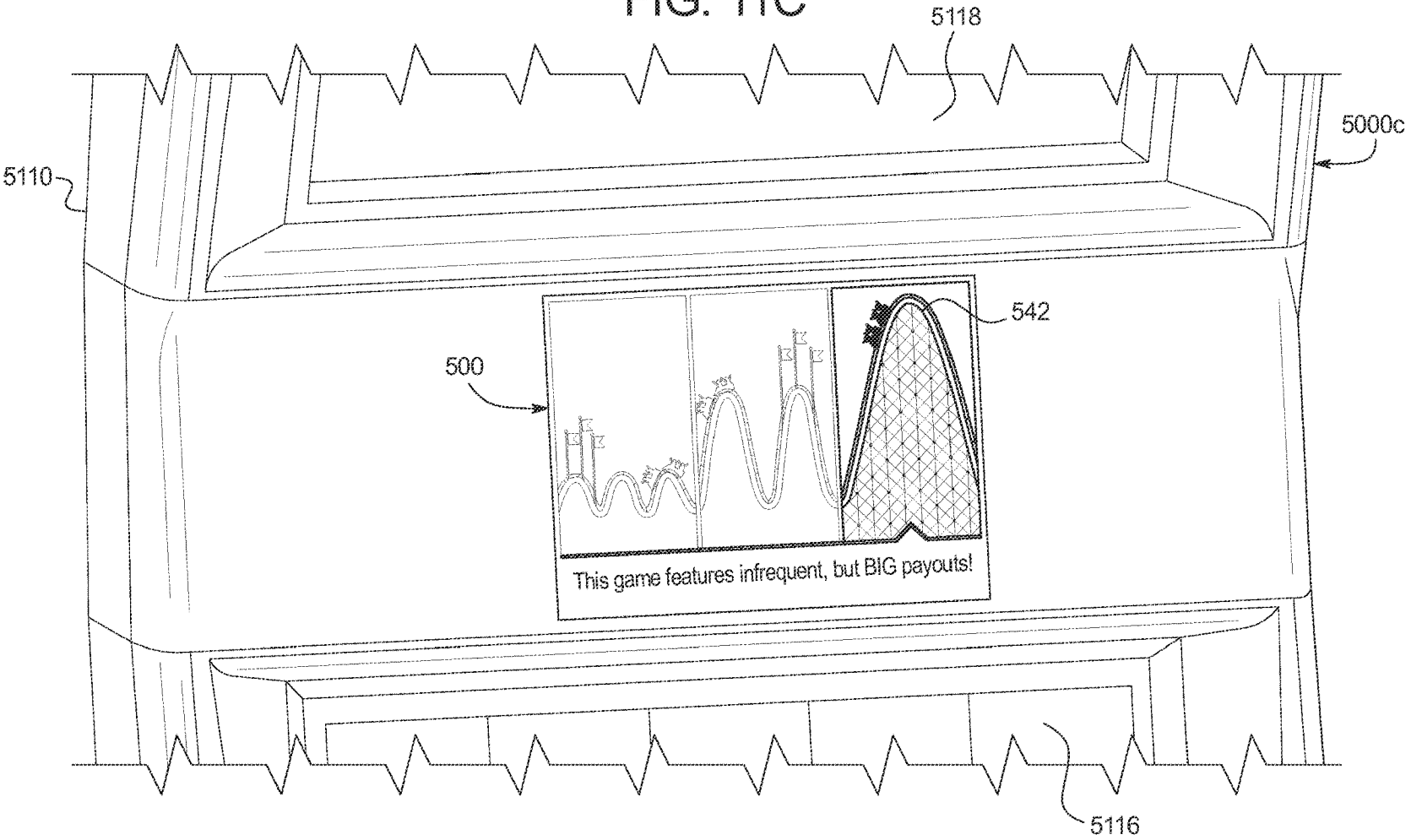
FIG. 11C is a perspective view of the gaming system volatility marker of FIG. 9A with the high volatility level indicator activated and attached to a gaming system (shown in fragmentary).

Turning now to FIGS. 9A, 9B, 10A, 10B, 10C, 11A, 11B, and 11C, another example embodiment of the gaming system volatility marker of the present disclosure is generally illustrated and indicated by numeral 500. The gaming system volatility marker 500 of this illustrated embodiment generally includes a base or housing 502 having an interior side 510 and an exterior side 520. The interior side 510 of the base or housing 502 of the gaming system volatility marker 500 is suitably configured to be attached to a gaming system such as gaming system 5000 as generally shown in FIGS. 11A, 11B, and 11C as further described below. The exterior side 520 of the base or housing 502 of the gaming system volatility marker 500 includes three distinct different activatable volatility level indicator sections 530, 540, and 550 that respectively include activatable volatility level indicators 532, 542, and 552. As described below, three different activatable volatility level indicators 532, 542, and 552 directly visually and non-verbally (e.g., without employing any written letters or numbers) inform the players of the volatility level of the gaming system 5000 and/or the volatility level of the gaming system 5000 compared to volatility levels of other gaming systems. It should be appreciated that, in various embodiments, the activatable volatility level indicators include supplemental verbal information distinct from and in addition to the activatable volatility level indicators that also informs players of the respective volatility levels (as described below).

More specifically, the first one of the activatable volatility level indicators 532 has: (i) a first wave shape (including a peak and valley quantity or frequency) indicating a first volatility level, and (ii) a first relatively small size also indicating the first volatility level. The second one of the activatable volatility level indicators 542 has: (i) a second wave shape (including a peak and valley quantity or frequency) indicating a second volatility level, and (ii) a second medium size also indicating the second volatility level. The third one of the activatable volatility level indicators 552 has: (i) a third wave shape (including a peak and valley quantity or frequency) indicating a third volatility level, and (ii) a third relatively large size also indicating the third volatility level. The first wave shape is different than the second wave shape and the third wave shape, and the second wave shape is different than the third wave shape. Additionally, the first wave size is different than the second wave size and the third wave size, and the second wave size is different than the third wave size. The first volatility level is different than the second volatility level and the third volatility level, and the second volatility level is different than the third volatility level.

In this example embodiment, the size of a given wave shape is the vertical distance between a representative crest and trough of the wave shape, though it should be appreciated that the size of a given wave shape may be determined in any other suitable manner such as, but not limited to: (a) length of the wave shape, and/or (b) amplitude of the wave shape.

This example embodiment includes verbal information in addition to the activatable volatility level indicators that also informs players of the respective volatility levels. More specifically: (a) the activatable volatility level indicator section 530 includes the following verbal information: "This game features frequent, smaller payouts, but you can still win big!"; (b) the activatable volatility level indicator section 540 includes the following verbal information: "This game has moderate fairly frequent, payouts, but you can still win big!"; and (c) the activatable volatility level indicator section 550 includes the following verbal information: "This game features infrequent, but BIG payouts!". It should be appreciated that any suitable verbal information may be employed in conjunction with and in addition to the activatable volatility level indicators of the gaming system volatility marker.

This embodiment of the present disclosure thus provides that the shape (including a peak and valley quantity or frequency) and size of each activatable volatility level indicator 532, 542, and 552 corresponds to a respective different volatility level. In this example embodiment: (1) the activatable volatility level indicator 532 corresponds to a low volatility level; (2) the activatable volatility level indicator 542 corresponds to a medium volatility level; and (3) the activatable volatility level indicator 552 corresponds to a high volatility level. It should be appreciated that the sizes and shapes of the waves may vary in accordance with the present disclosure. It should also be appreciated that which sizes and shapes of the waves correspond to which volatilities may vary in accordance with the present disclosure.

In this example embodiment, each of the activatable volatility level indicators 532, 542, and 552 are individually activatable. As described above, in one form, each activatable volatility level indicator 532, 542, and 552 is individually activated by illumination. As described above, in another form, each activatable volatility level indicator 532, 542, and 552 is individually activated by movement. In another form, each activatable volatility level indicator 532, 542, and 552 is individually activated by emphasis, contrast, or color such as shown in FIGS. 10A, 10B, and 10C. It should be appreciated that each of the different activatable volatility level indicator sections can be of different colors. In one such embodiment, when a particular activatable volatility level indicator section is activated, that activatable volatility level indicator section has or includes a specific color (such green, orange, or red), and when that activatable volatility level indicator section is not activated, that activatable volatility level indicator section is does not include any of these colors and, for instance, includes only black and white.

In various embodiments: (a) when the volatility level indicator 532 is activated and the volatility level indicators 542 and 552 are not activated, the volatility level indicator section 530 and includes the color green, while the volatility level indicator sections 540 and 550 do not include the color green (and may, for instance include the colors black and white); (b) when the volatility level indicator 542 is activated and the volatility level indicators 532 and 552 are not activated, the volatility level indicator section 540 includes the color orange, while the volatility level indicator sections 530 and 550 do not include the color orange (and may, for instance, include the colors black and white); and (c) when the volatility level indicator 552 is activated and the volatility level indicators 532 and 542 are not activated, the volatility level indicator section 550 includes the color red, while the volatility level indicator sections 530 and 540 do not include the color red (and may, for instance, include the colors black and white).

More specifically: (a) FIG. 10A illustrates the volatility level indicator 532 activated and the volatility level indicators 542 and 552 not activated, (b) FIG. 10B illustrates the volatility level indicator 534 activated and the volatility level indicators 532 and 552 not activated, and (c) FIG. 10C illustrates the volatility level indicator 552 activated and the volatility level indicators 532 and 542 not activated. Additionally: (a) the gaming system volatility marker of FIG. 10A with the volatility level indicator 532 activated includes the following verbal information: "This game features frequent, smaller payouts, but you can still win big!"; (b) the gaming system volatility marker of FIG. 10B with the volatility level indicator 534 activated includes the following verbal information: "This game has moderate fairly frequent, payouts, but you can still win big!"; and (c) the gaming system volatility marker of FIG. 10C with volatility level indicator 552 activated includes the following verbal information: "This game features infrequent, but BIG payouts!".

When the volatility level indicator 532 is activated, this directly visually and non-verbally informs players that the gaming system to which the gaming system volatility marker 500 is attached has the low volatility level. When the volatility level indicator 542 is activated, this directly visually and non-verbally informs the player that the gaming system to which the gaming system volatility marker 500 is attached has the medium volatility level. When the volatility level indicator 552 is activated, this directly visually and non-verbally informs the player that the gaming system to which the gaming system volatility marker 500 is attached has the high volatility level. The wave shape (including a peak and valley quantity or frequency) and size of each of the activatable volatility level indicators thus assist the player in understanding the volatility level of the gaming system as well as the volatility level of the gaming system compared to other gaming systems.

In certain embodiments, such volatility markers are formed with particular volatility level indicators already activated and, therefore, do not include or need to include or otherwise be operatively connected to a power source or an activation mechanism to activate or deactivate the volatility level indicators. In other words, in these embodiments, the volatility level indicators of the volatility markers are not activatable; rather, the volatility markers are formed with one or more permanently activated volatility level indicators.

The gaming system volatility marker 500 of this embodiment of the present disclosure is configured to be attached to gaming systems 5000*a*, 5000*b*, and 5000*c* as generally shown in FIGS. 11A, 11B, and 11C. In this illustrated embodiment, the gaming system volatility marker 500 is attached to each respective gaming system 5000*a*, 5000*b*, and 5000*c* in a generally central location of the gaming systems such that the gaming system volatility markers 500 are easily and readily seen by players. It should be appreciated that the present disclosure contemplates that the gaming system volatility marker 500 can be attached to a gaming system in any suitable manner and at any suitable location or position as long as it is viewable by players.

In this illustrated embodiment, each gaming system 5000*a*, 5000*b*, and 5000*c* includes a housing 5110, two display devices 5116 and 5118 supported by the housing 5110, a plurality of input devices (not shown) supported by the housing 5110, at least one processor (not shown), and at least one memory device (not shown) that stores a plurality of instructions which, when executed by the at least one processor, cause the at least one processor to operate with the display devices and the input devices to display play of at least one game. Other example gaming systems are further described below.

In this embodiment, the at least one game includes at least one primary or base game and can also include at least one secondary or bonus game. As explained above, the volatility level of a gaming system is determined based on or otherwise depends on the volatility level(s) of the game(s) that that particular gaming system is configured to operate. Thus, in this example embodiment, the volatility levels of the gaming systems 5000*a*, 5000*b*, and 5000*c* are determined based on the volatility level(s) of the at least one game that the gaming systems 5000*a*, 5000*b*, and 5000*c* are configured to operate. In this embodiment: (a) the at least one game that the gaming system 5000*a* is configured to operate has the low volatility level and, therefore, the gaming system 5000*a* has the low volatility level; (b) the at least one game that the gaming system 5000*b* is configured to operate has the medium volatility level and, therefore, the gaming system 5000*b* has the medium volatility level; and (c) the at least one game that the gaming system 5000*c* is configured to operate has the high volatility level and, therefore, the gaming system 5000*c* has the high volatility level.

Accordingly, as shown in FIGS. 11A, 11B, and 11C, each of the volatility level indicators 532, 542, and 552 are respectively activated and thus indicate the respective volatility level of each of the gaming systems 5000*a*, 5000*b*, and 5000*c* (and, specifically, the respective volatility levels of the at least one game that the gaming systems 5000*a*, 5000*b*, and 5000*c* are configured to operate) to which the volatility markers 500 are attached. Thus: (a) when a player looks at (or walks up to) the gaming system 5000*a* illustrated in FIG. 11A, the size and shape of the activated volatility level indicator 532 directly visually and non-verbally informs the player of the low volatility level of the gaming system 5000*a*; (b) when a player looks at (or walks up to) the gaming system 5000*b* illustrated in FIG. 11B, the size and shape of the activated volatility level indicator 542 directly visually and non-verbally informs the player of the medium volatility level of the gaming system 5000*b*; and (c) when a player looks at (or walks up to) the gaming system 5000*c* illustrated in FIG. 11C, the size and shape of the activated volatility level indicator 552 directly visually and non-verbally informs the player of the high volatility level of the gaming system 5000*c*.

It should be appreciated that in conjunction with these volatility markers additional information can be provided to players regarding the respective volatility levels associated with each of the different activatable volatility level indicators separately from the gaming system volatility markers.

Additionally, when a player looks at (or walks up to) any of the gaming systems 5000*a*, 5000*b*, and 5000*c*, the respective volatility marker 500 directly visually and non-verbally informs the player of the comparative volatility of that gaming system to other gaming systems (not shown) in the casino or other gaming establishment (not shown). In this example embodiment: (1) if the activatable volatility level indicator 532 is activated, the player can see that the gaming system 5000*a* has the low volatility level and that other gaming systems (such as other gaming systems in the casino or other gaming establishment) respectively have the medium volatility level and the high volatility level; (2) if the activatable volatility level indicator 542 is activated, the player can see that the gaming system 5000*b* has the medium volatility level and that other gaming systems (such as other gaming systems in the casino or other gaming establishment) respectively have the low volatility level and the high volatility level; and (3) if the volatility level indicator 552 is activated, the player can see that the gaming system 5000*c* has the high volatility level and that other gaming systems (such as other gaming systems in the casino or other gaming establishment) respectively have the medium volatility level and the low volatility level.

Turning now to FIGS. 12A, 12B, 12C, 13A, 13B, and 13C, another example embodiment of the gaming system volatility markers of the present disclosure are generally illustrated and indicated by numerals 600, 700, and 800. These gaming system volatility markers are similar to the gaming system volatility marker 500, but each of the activatable volatility level indicator sections 530, 540, and 550 are physically separate or independent.

Figure 12A:
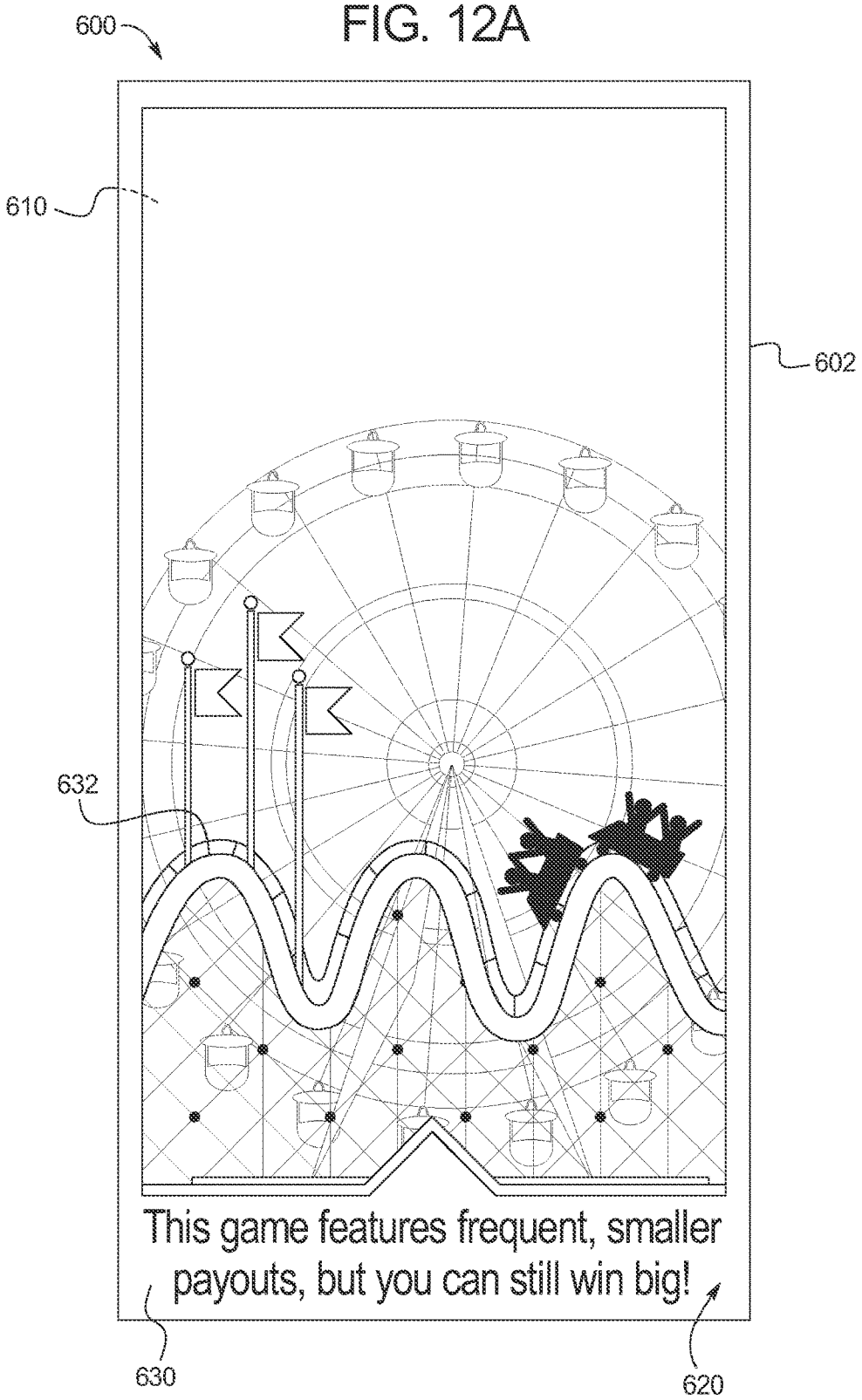
FIGS. 12A, 12B, and 12C are front views of the gaming system volatility markers of another embodiment the present disclosure.
Figure 13A:
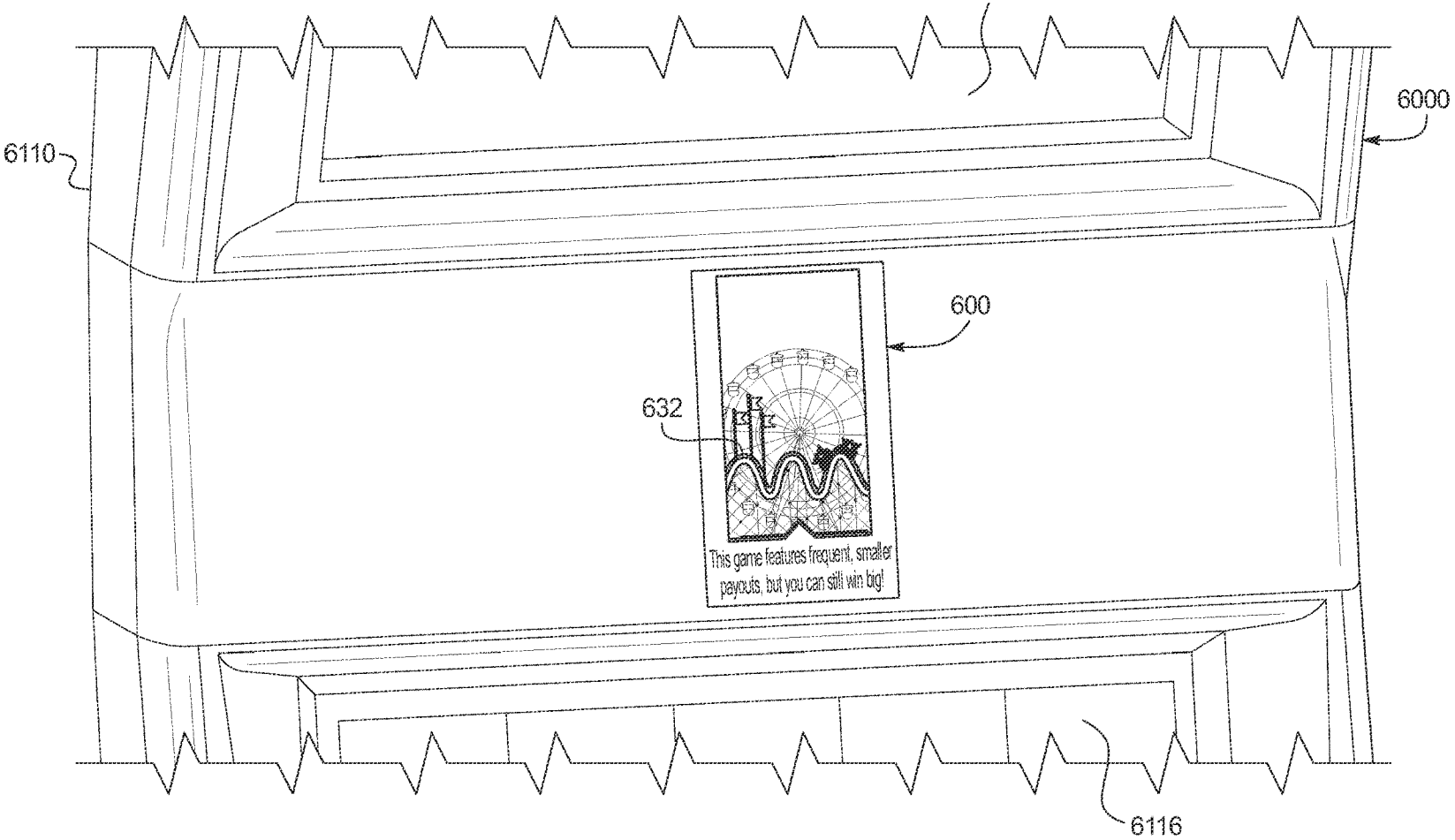
FIGS. 13A, 13B, and 13C are perspective views of the gaming system volatility markers of FIGS. 12A, 12B, and 12C respectively attached to gaming systems (shown in fragmentary).

The gaming system volatility marker 600 of this illustrated embodiment generally includes a base or housing 602 having an interior side 610 and an exterior side 620 as shown in FIG. 12A. The interior side 610 of the base or housing 602 of the gaming system volatility marker 600 is suitably configured to be attached to a gaming system such as gaming system 6000 as generally shown in FIG. 13A as further described below. The exterior side 620 of the base or housing 602 of the gaming system volatility marker 600 includes an activatable volatility level indicator section 630 that includes activatable volatility level indicator 632.

Figure 12B:
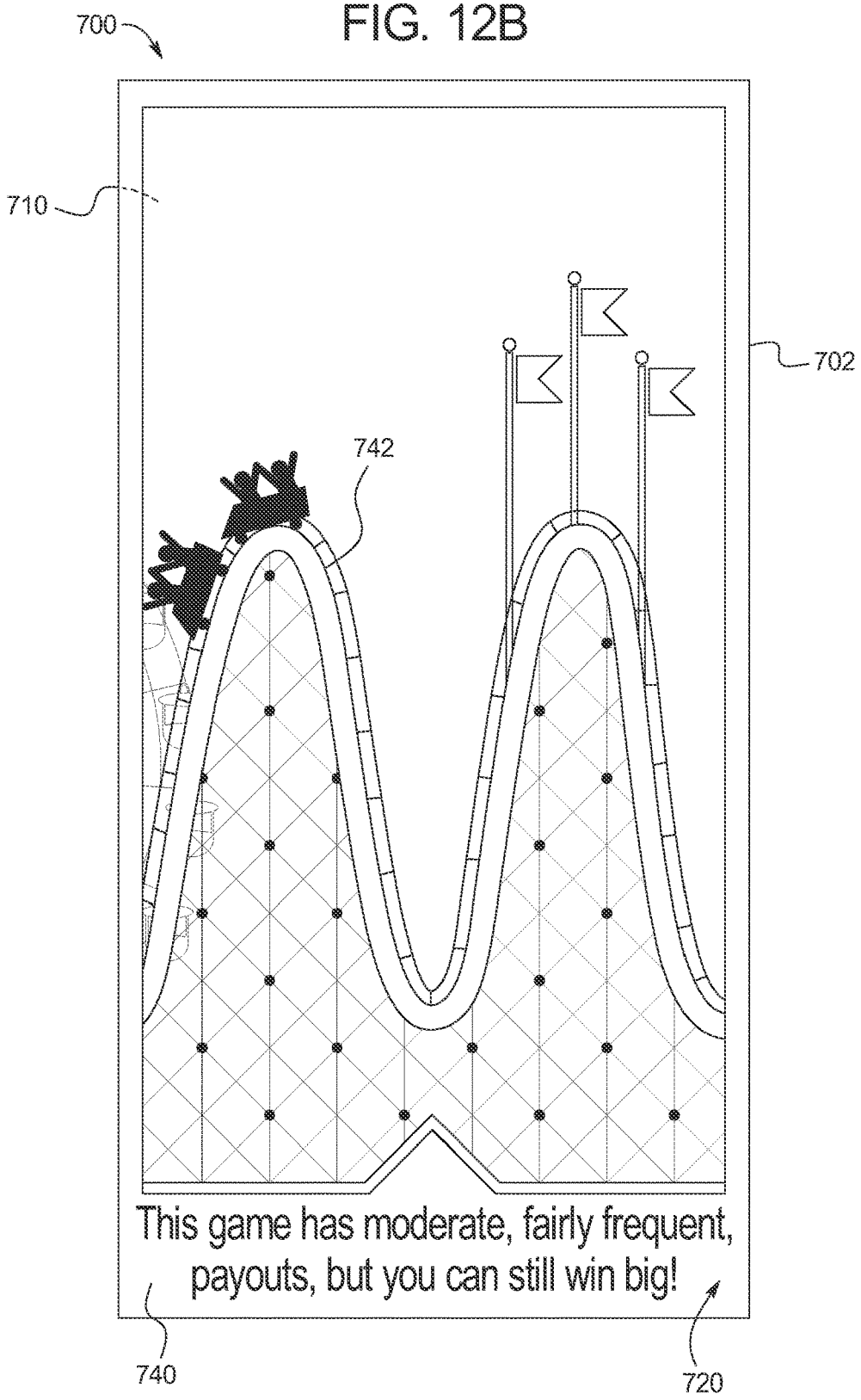
Figure 13B:
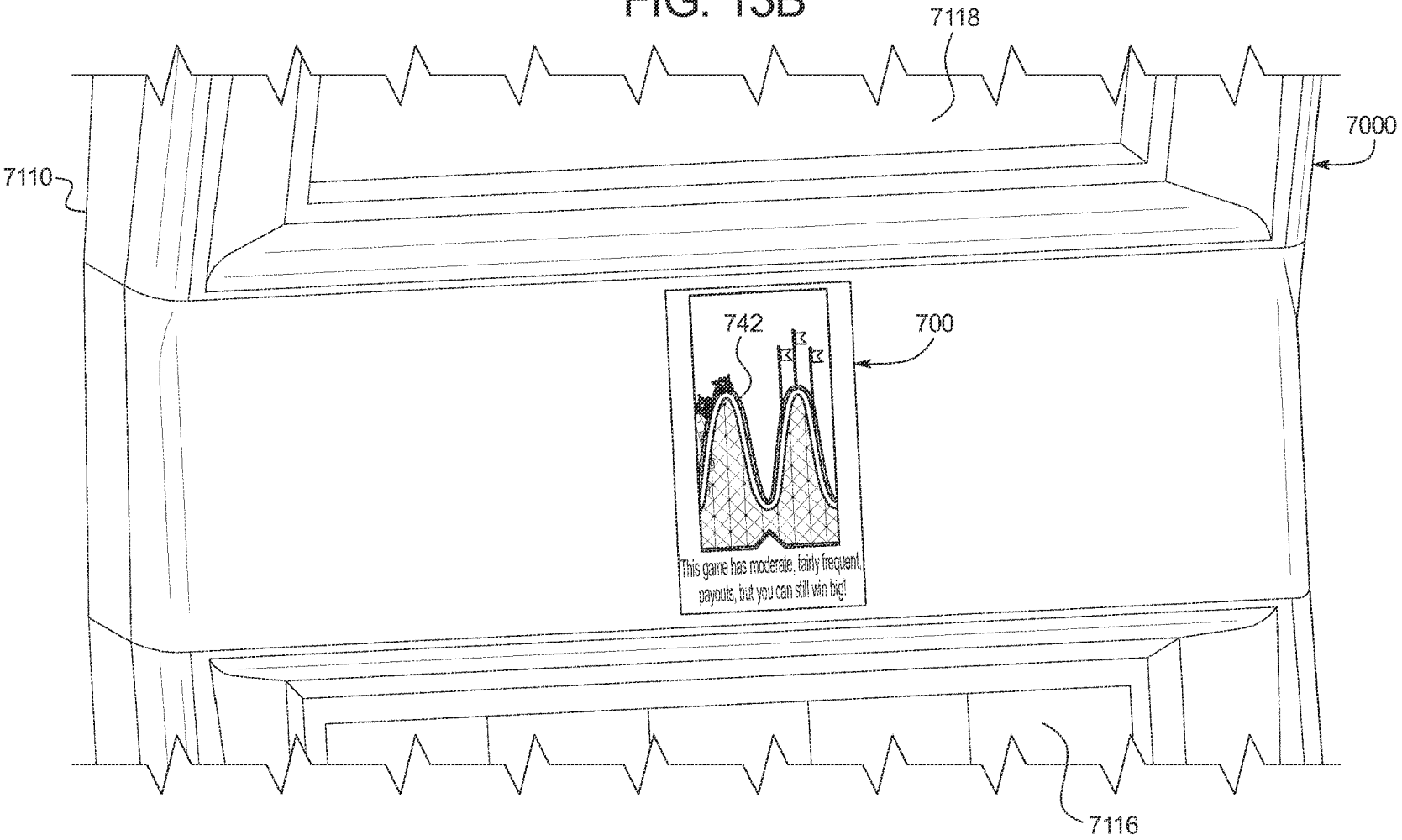

The gaming system volatility marker 700 of this illustrated embodiment generally includes a base or housing 702 having an interior side 710 and an exterior side 720 as shown in FIG. 12B. The interior side 710 of the base or housing 702 of the gaming system volatility marker 700 is suitably configured to be attached to a gaming system such as gaming system 7000 as generally shown in FIG. 13B as further described below. The exterior side 720 of the base or housing 702 of the gaming system volatility marker 700 includes an activatable volatility level indicator section 730 that includes activatable volatility level indicator 742.

Figure 12C:
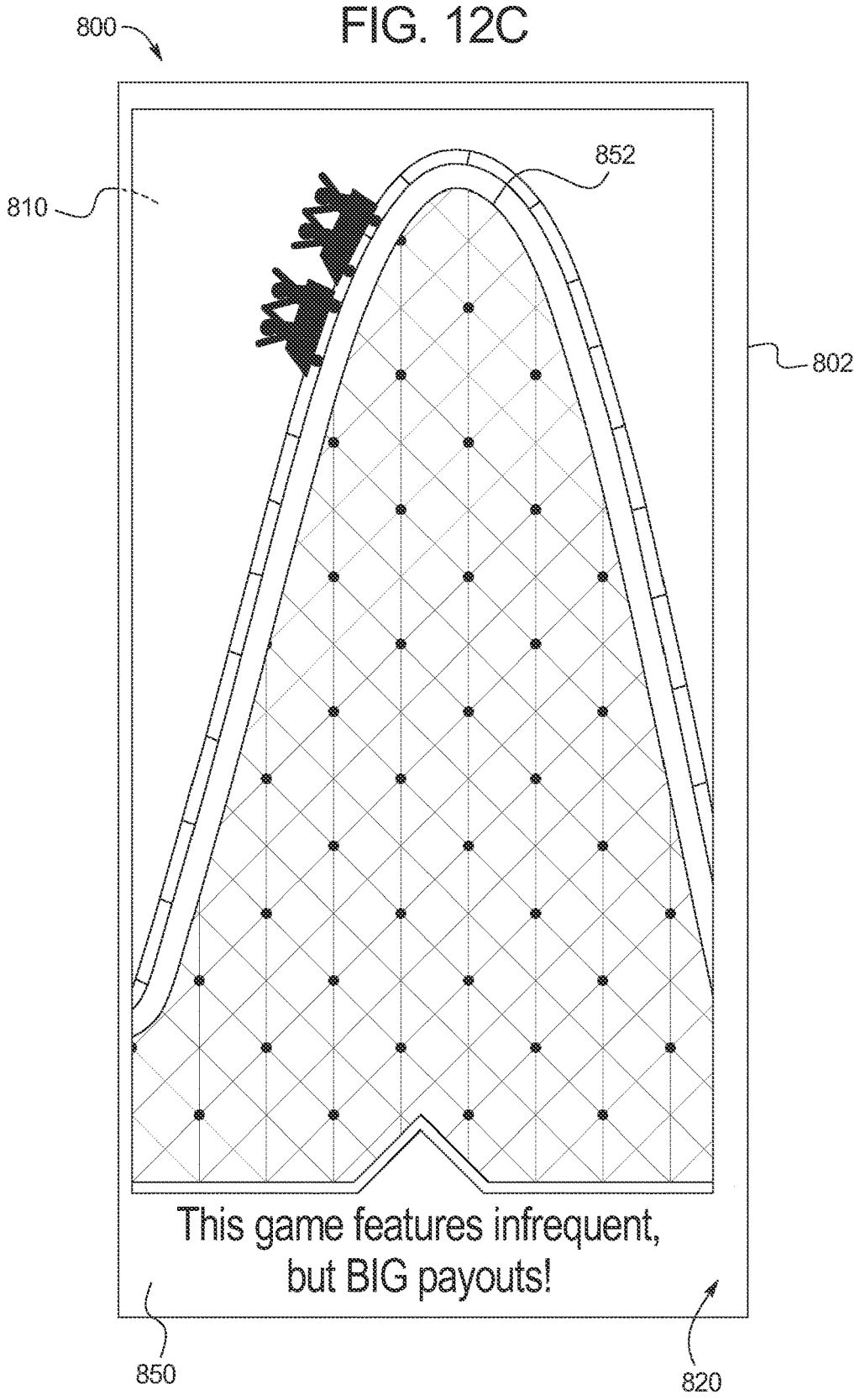
Figure 13C:
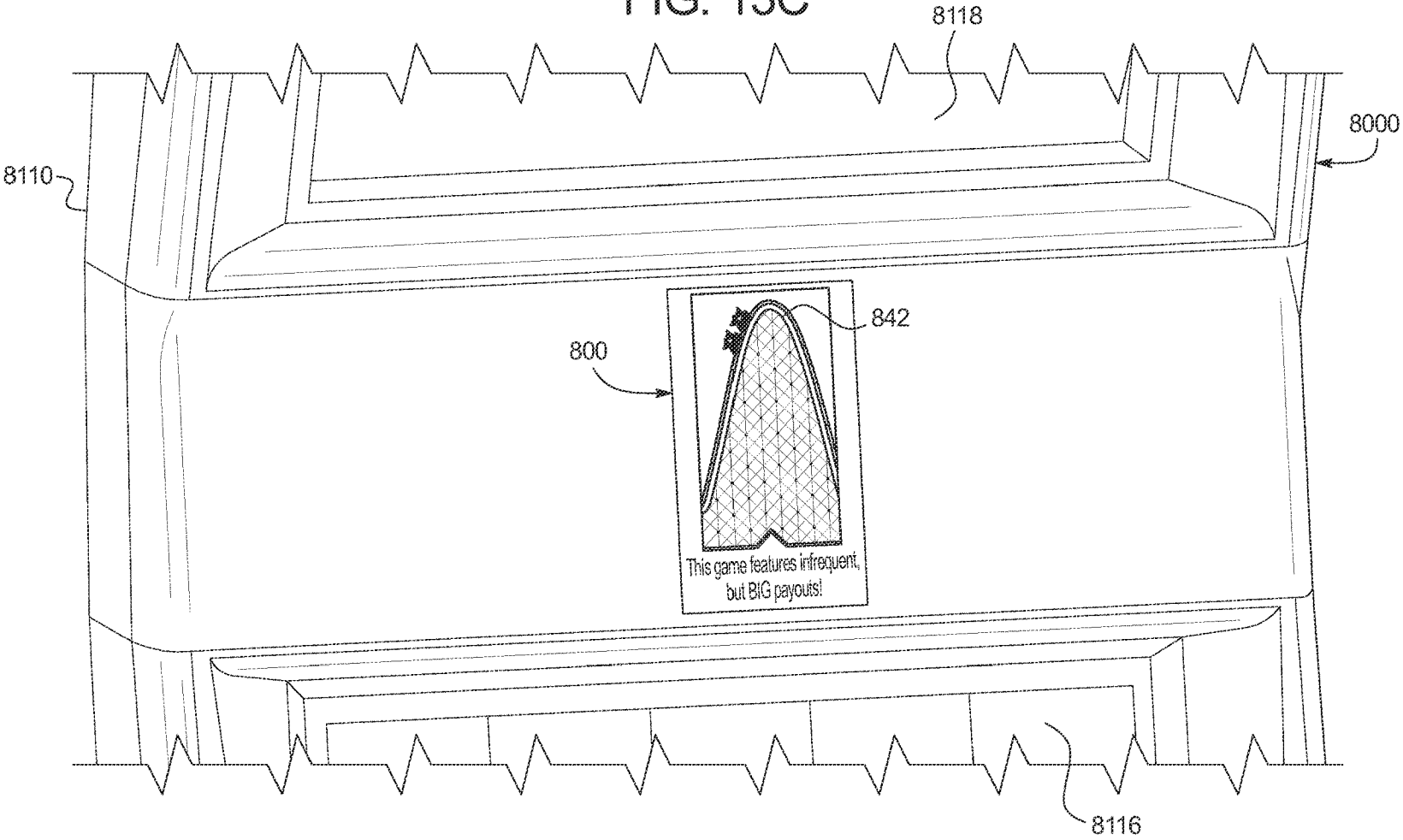

The gaming system volatility marker 800 of this illustrated embodiment generally includes a base or housing 802 having an interior side 810 and an exterior side 820 as shown in FIG. 12C. The interior side 810 of the base or housing 802 of the gaming system volatility marker 800 is suitably configured to be attached to a gaming system such as gaming system 8000 as generally shown in FIG. 13C as further described below. The exterior side 820 of the base or housing 802 of the gaming system volatility marker 800 includes an activatable volatility level indicator section 830 that includes activatable volatility level indicator 852.

As described below, three different activatable volatility level indicators 632, 742, and 852 directly visually and non-verbally (e.g., without employing any written letters or numbers) respectively inform the players of the volatility levels of the gaming systems 6000, 7000, and 8000 and/or the volatility levels of the gaming systems 6000, 7000, and 8000 compared to volatility levels of other gaming systems.

More specifically, the first one of the activatable volatility level indicators 632 has: (i) a first wave shape (including a peak and valley quantity or frequency) indicating a first volatility level, and (ii) a first relatively small size also indicating the first volatility level. The second one of the activatable volatility level indicators 742 has: (i) a second wave shape (including a peak and valley quantity or frequency) indicating a second volatility level, and (ii) a second medium size also indicating the second volatility level. The third one of the activatable volatility level indicators 852 has: (i) a third wave shape (including a peak and valley quantity or frequency) indicating a third volatility level, and (ii) a third relatively large size also indicating the third volatility level. The first wave shape is different than the second wave shape and the third wave shape, and the second wave shape is different than the third wave shape. Additionally, the first wave size is different than the second wave size and the third wave size, and the second wave size is different than the third wave size. The first volatility level is different than the second volatility level and the third volatility level, and the second volatility level is different than the third volatility level.

This example embodiment includes verbal information in addition to the activatable volatility level indicators that also informs players of the respective volatility levels. More specifically: (a) the activatable volatility level indicator section 630 includes the following verbal information: "This game features frequent, smaller payouts, but you can still win big!"; (b) the activatable volatility level indicator section 740 includes the following verbal information: "This game has moderate fairly frequent, payouts, but you can still win big!"; and (c) the activatable volatility level indicator section 850 includes the following verbal information: "This game features infrequent, but BIG payouts!". It should be appreciated that any suitable verbal information may be employed in conjunction with and in addition to the activatable volatility level indicators of the gaming system volatility marker.

This embodiment of the present disclosure thus provides that the shape (including a peak and valley quantity or frequency) and size of each activatable volatility level indicator 632, 742, and 852 corresponds to a respective different volatility level. In this example embodiment: (1) the activatable volatility level indicator 632 corresponds to a low volatility level; (2) the activatable volatility level indicator 742 corresponds to a medium volatility level; and (3) the activatable volatility level indicator 852 corresponds to a high volatility level. It should be appreciated that the sizes and shapes of the waves may vary in accordance with the present disclosure. It should also be appreciated that which sizes and shapes of the waves correspond to which volatilities may vary in accordance with the present disclosure.

In this example embodiment, each of the volatility level indicators 632, 742, and 852 are individually activatable. As described above, in one form, each volatility level indicator 632, 742, and 852 is individually activated by illumination. As described above, in another form, each volatility level indicator 632, 742, and 852 is individually activated by movement. As described above, in another form, each volatility level indicator 632, 742, and 852 is individually activated by emphasis or contrast. In another form, in this illustrated embodiment, each volatility level indicators 632, 742, and 852 is individually activated by being separately employed as generally illustrated in FIGS. 13A, 13B, and 13C.

More specifically: (a) FIG. 13A illustrates volatility level indicator 632 activated, (b) FIG. 13B illustrates volatility level indicator 734 activated, and (c) FIG. 13C illustrates volatility level indicator 852 activated. Additionally: (a) the gaming system volatility marker of FIG. 13A with the volatility level indicator 632 activated includes the following verbal information: "This game features frequent, smaller payouts, but you can still win big!"; (b) the gaming system volatility marker of FIG. 13B with the volatility level indicator 742 activated includes the following verbal information: "This game has moderate fairly frequent, payouts, but you can still win big!"; and (c) the gaming system volatility marker of FIG. 13C with the volatility level indicator 852 activated includes the following verbal information: "This game features infrequent, but BIG payouts!".

In other words, (a) when the volatility level indicator 632 is activated, this directly visually and non-verbally informs the player that the gaming system to which the gaming system volatility marker 600 is attached has the low volatility level; (b) when the volatility level indicator 742 is activated, this directly visually and non-verbally informs the player that the gaming system to which the gaming system volatility marker 700 is attached has the medium volatility level; and (c) when the volatility level indicator 852 is activated, this directly visually and non-verbally informs the player that the gaming system to which the gaming system volatility marker 800 is attached has the high volatility level. The shape including a peak and valley quantity or frequency) and size of each of the volatility level indicators thus assist the player in understanding the volatility level of the gaming system and the volatility level of the gaming system when compared to other gaming systems.

The gaming system volatility markers 600, 700, and 800 of this embodiment of the present disclosure are each configured to be respectively attached to gaming systems 6000, 7000, and 8000 as generally shown in FIGS. 13A, 13B, and 13C. In this illustrated embodiment, the gaming system volatility markers are attached to the respective gaming systems in generally central locations of the gaming systems such that the gaming system volatility markers are easily and readily seen by players. It should be appreciated that the present disclosure contemplates that the gaming system volatility marker can be attached to a gaming system in any suitable manner and at any suitable location or position as long as it is viewable by players.

In certain embodiments, such volatility markers are formed with particular volatility level indicators already activated and, therefore, do not include or need to include or otherwise be operatively connected to a power source or an activation mechanism to activate or deactivate the volatility level indicators. In other words, in these embodiments, the volatility level indicators of the volatility markers are not activatable; rather, the volatility markers are formed with one or more permanently activated volatility level indicators.

In this illustrated embodiment, the gaming systems 6000, 7000, and 8000 each includes a housing 6110, 7110, and 8110, respectively; two display devices 6116 and 6118, 7116 and 7118, and 8116 and 8118, respectively supported by the housings 6110, 7110, and 8118; a plurality of input devices (not shown) supported by the housings 6110, 7110, and 8110; at least one processor (not shown), and at least one memory device (not shown) that stores a plurality of instructions which, when executed by the at least one processor, cause the at least one processor to operate with the display devices and the input devices to display play of at least one game. Other example gaming systems are further described below.

In this embodiment, the at least one game includes at least one primary or base game and can also include at least one secondary or bonus game. As explained above, the volatility level of a gaming system is determined based on or otherwise depends on the volatility level(s) of the game(s) that that particular gaming system is configured to operate. Thus, in this example embodiment, the volatility levels of the gaming systems 6000, 7000, and 8000 are determined based on the volatility level(s) of the at least one game that the gaming systems 6000, 7000, and 8000 are configured to operate. In this embodiment: (a) the at least one game that the gaming system 6000 is configured to operate has the low volatility level and, therefore, the gaming system 6000 has the low volatility level; (b) the at least one game that the gaming system 7000 is configured to operate has the medium volatility level and, therefore, the gaming system 7000 has the medium volatility level; and (c) the at least one game that the gaming system 8000 is configured to operate has the high volatility level and, therefore, the gaming system 8000 has the high volatility level.

Accordingly, as shown in FIGS. 13A, 13B, and 13C, each of the volatility level indicators 632, 742, and 852 are respectively activated and thus indicate the respective volatility level of each of the gaming systems 6000, 7000, and 8000 (and, specifically, the respective volatility levels of the at least one game that the gaming systems 6000, 7000, and 8000 are configured to operate) to which the volatility markers 600, 700, and 800 are attached. Thus: (a) when a player looks at (or walks up to) the gaming system 6000 illustrated in FIG. 13A, the size and shape of the activated volatility level indicator 632 directly visually and non-verbally informs the player of the low volatility level of the gaming system 6000; (b) when a player looks at (or walks up to) the gaming system 7000 illustrated in FIG. 13B, the size and shape of the activated volatility level indicator 742 directly visually and non-verbally informs the player of the medium volatility level of the gaming system 7000; and (c) when a player looks at (or walks up to) the gaming system 8000 illustrated in FIG. 13C, the size and shape of the activated volatility level indicator 852 directly visually and non-verbally informs the player of the high volatility level of the gaming system 8000.

It should be appreciated that in conjunction with these volatility markers additional information can be provided to players regarding the respectively volatilities associated with each of the different activatable volatility level indicators separately from the gaming system volatility markers.

Additionally, when a player looks at (or walks up to) any of the gaming systems 6000, 7000, and 8000, the respective volatility marker directly visually and non-verbally informs the player of the comparative volatility of that gaming system to other gaming systems (not shown) in the casino or gaming establishment (not shown). In this example embodiment: (1) if the activatable volatility level indicator 632 is activated, the player can see that the gaming system 6000 has the low volatility level and that other gaming systems (such as other gaming systems in the casino or other gaming establishment) respectively have the medium volatility level or the high volatility level; (2) if the activatable volatility level indicator 742 is activated, the player can see that the gaming system 7000 has the medium volatility level and that other gaming systems (such as other gaming systems in the casino or other gaming establishment) respectively have the low volatility level or the high volatility level; and (3) if the activatable volatility level indicator 852 is activated, the player can see that the gaming system 8000 has the high volatility level and that other gaming systems (such as other gaming systems in the casino or other gaming establishment) respectively have the medium volatility level or the low volatility level.

In other embodiments, the activatable volatility level indicators of a gaming system volatility marker share the same shape, but have different sizes that indicate different volatility levels. For instance, in one example embodiment, a first one of the activatable volatility level indicators has a $ shape in a small size indicating a first volatility level, a second one of the activatable volatility level indicators has the $ shape in a medium size a second volatility level, and a third one of the activatable volatility level indicators has the $ shape in a large size indicating a third volatility level.

In further embodiments, different quantities of activatable volatility level indicators having the same size and shape correspond to different volatility levels. For instance in one example embodiment: (1) a first quantity of activatable volatility level indicators in a first set (e.g., 3 $ symbols) corresponds to a first volatility level; (2) a second quantity of activatable volatility level indicators in a second set (e.g., 2 $ symbols) corresponds to a second volatility level; and (3) a third quantity of activatable volatility level indicators in a third set (e.g., 1 $ symbol) corresponds to a third volatility level.

In other embodiments, the activatable volatility level indicators of a gaming system volatility marker share the same shape, but have different sizes that indicate different volatility levels. Further, in these embodiments, different quantities of activatable volatility level indicators having the same size and shape correspond to different volatility levels. For instance in one example embodiment: (1) a first quantity and size of activatable volatility level indicators in a first set (e.g., 3 small $ symbols) correspond to a first volatility level; (2) a second quantity and size of activatable volatility level indicators in a second set (e.g., 2 medium $ symbols) correspond to a second volatility level; and (3) a third quantity and size of activatable volatility level indicators in a third set (e.g., 1 large $ symbol) corresponds to a third volatility level.

The gaming system volatility markers of the present disclosure can be attached to newly manufactured gaming systems as well as existing gaming systems.

In alternative embodiments, the gaming system volatility marker can be electrically connected to the gaming system in accordance with the present disclosure. In one such embodiment, the gaming system volatility marker is powered by the gaming system.

In other embodiments of the present disclosure, the gaming system displays the gaming system volatility marker. In one such embodiment, the gaming system volatility marker is permanently formed in the gaming system such as in one of the panels of the gaming system. In other embodiments, the gaming system volatility marker is displayed by one of the display devices of the gaming system. In certain such embodiments, the upper display device of the gaming system displays the gaming system volatility marker when the gaming system is not being played.

In another embodiment, the gaming system causes the activatable volatility level indicator to be displayed in one or more service windows or pop-up screens.

In another embodiment, in addition or in alternative to each electronic gaming machine displaying the activatable volatility level indicator, the gaming system causes one or more internet sites to each display the activatable volatility level indicator such that a player is enabled to log on from a personal web browser.

In another embodiment, in addition or in alternative to each electronic gaming machine displaying the activatable volatility level indicator, one or more players, the gaming system causes one or more community or overhead display devices to display the activatable volatility level indicator to one or more other players or bystanders either at a gaming establishment or viewing over a network, such as the internet.

In another such embodiment, the gaming system enables the player to play one or more games on one device while viewing the activatable volatility level indicator from another device, such as a desktop or laptop computer.

The example embodiments of the present disclosure described above are directed to gaming system volatility markers and gaming systems having volatility markers that correspond to all of the games of the gaming systems. In alternative embodiments, the present disclosure contemplates that the gaming system volatility markers correspond to fewer than all of or only certain of the games of the gaming system. For example, the gaming system volatility markers can correspond to the primary or base game(s) of the gaming system and not any secondary or bonus games of the gaming system. In other examples, the gaming system volatility markers can correspond to the secondary or bonus game(s) of the gaming system and not any primary games of the gaming system.

As mentioned above, in various embodiments, the gaming system provides one or more awards in association with one or more primary game plays, and/or one or more secondary game plays. These awards may include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, and/or an access code usable to unlock content on an internet.

In different embodiments, the indicated volatility level is associated with one or more plays of one or more games including, but not limited to: a play of any suitable slot game, a play of any suitable free spins or free activations game, a play of any suitable wheel game, a play of any suitable card game, a play of any suitable offer and acceptance game, a play of any suitable award ladder game, a play of any suitable puzzle-type game, a play of any suitable persistence game, a play of any suitable selection game, a play of any suitable cascading symbols game, a play of any suitable ways to win game, a play of any suitable scatter pay game, a play of any suitable coin-pusher game, a play of any suitable elimination game, a play of any suitable stacked wilds game, a play of any suitable trail game, a play of any suitable bingo game, a play of any suitable video scratch-off game, a play of any suitable pick-until-complete game, a play of any suitable shooting simulation game, a play of any suitable racing game, a play of any suitable promotional game, a play of any suitable high-low game, a play of any suitable lottery game, a play of any suitable number selection game, a play of any suitable dice game, a play of any suitable skill game, a play of any suitable auction game, a play of any suitable reverse-auction game, a play of any suitable group game or a play of any other suitable type of game.

The present disclosure also includes a method of manufacturing a gaming system or a method of causing a gaming system to indicate the volatility level of the gaming system.

In one such embodiment, the method includes (a) identifying a volatility level of the gaming system, and (b) affixing a volatility marker to the gaming system, the volatility marker including an interior side and an exterior side, the exterior side of the volatility marker including at least two different volatility level indicators, wherein: (i) a first of the volatility level indicators has: (a) a first shape indicating a first volatility level of the gaming system, and (b) a first size indicating the first volatility level of the gaming system, and (ii) a second of the volatility level indicators has: (a) a second, different shape indicating a second, different volatility level of a second different gaming system, and (b) a second, different size indicating the second, different volatility level of the second different gaming system.

In another embodiment the method includes (a) identifying a volatility level of the gaming system, and (b) affixing a volatility marker to the gaming system, the volatility marker including an interior side configured to be attached to a housing of the gaming system and the exterior side of the volatility marker including a first volatility level indicator having: (i) a first shape indicating a first volatility level of the gaming system, and (ii) a first size indicating the first volatility level of the gaming system, wherein the first volatility level indicator is different than a second volatility level indicator for a second different gaming system, wherein the different second volatility level indicator has: (a) a second, different shape indicating a second, different volatility level of the second different gaming system, and (b) a second, different size indicating the second, different volatility level of the second different gaming system.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 14A:
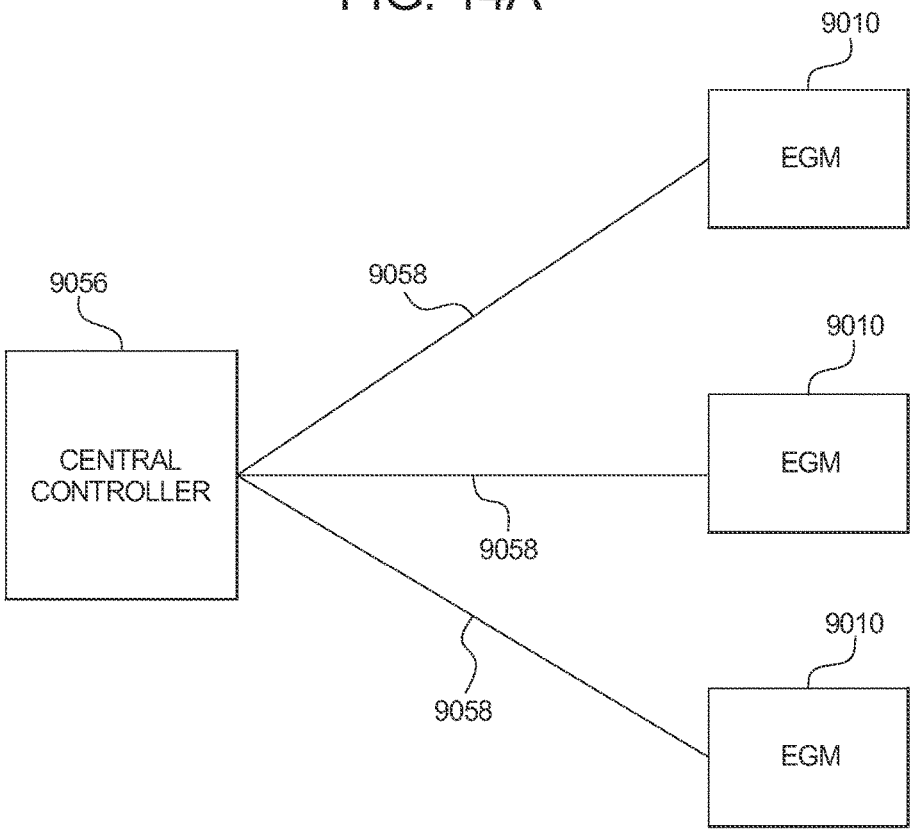
FIG. 14A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 14A includes a plurality of EGMs 9010 that are each configured to communicate with a central server, central controller, or remote host 9056 through a data network 9058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player, by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 14B:
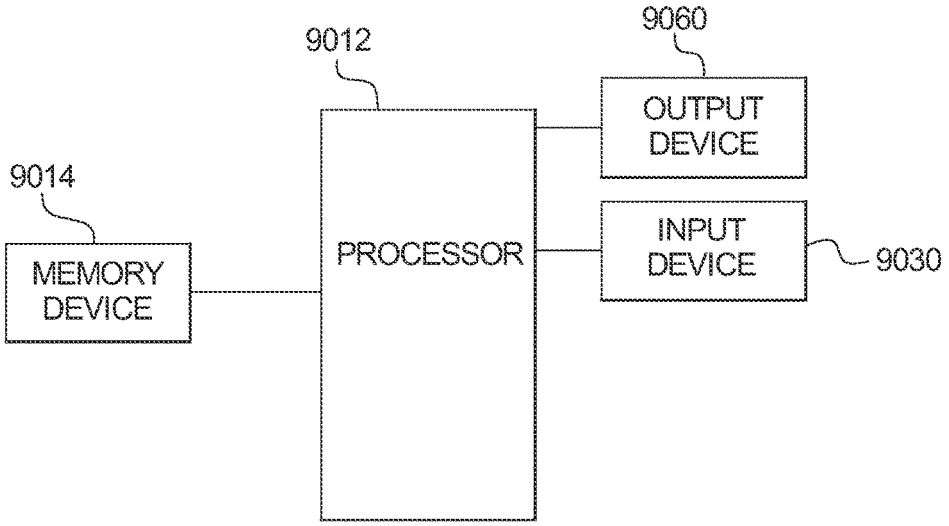
FIG. 14B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 14B illustrates an example EGM including a processor 9012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 14B includes a memory device 9014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 15A:
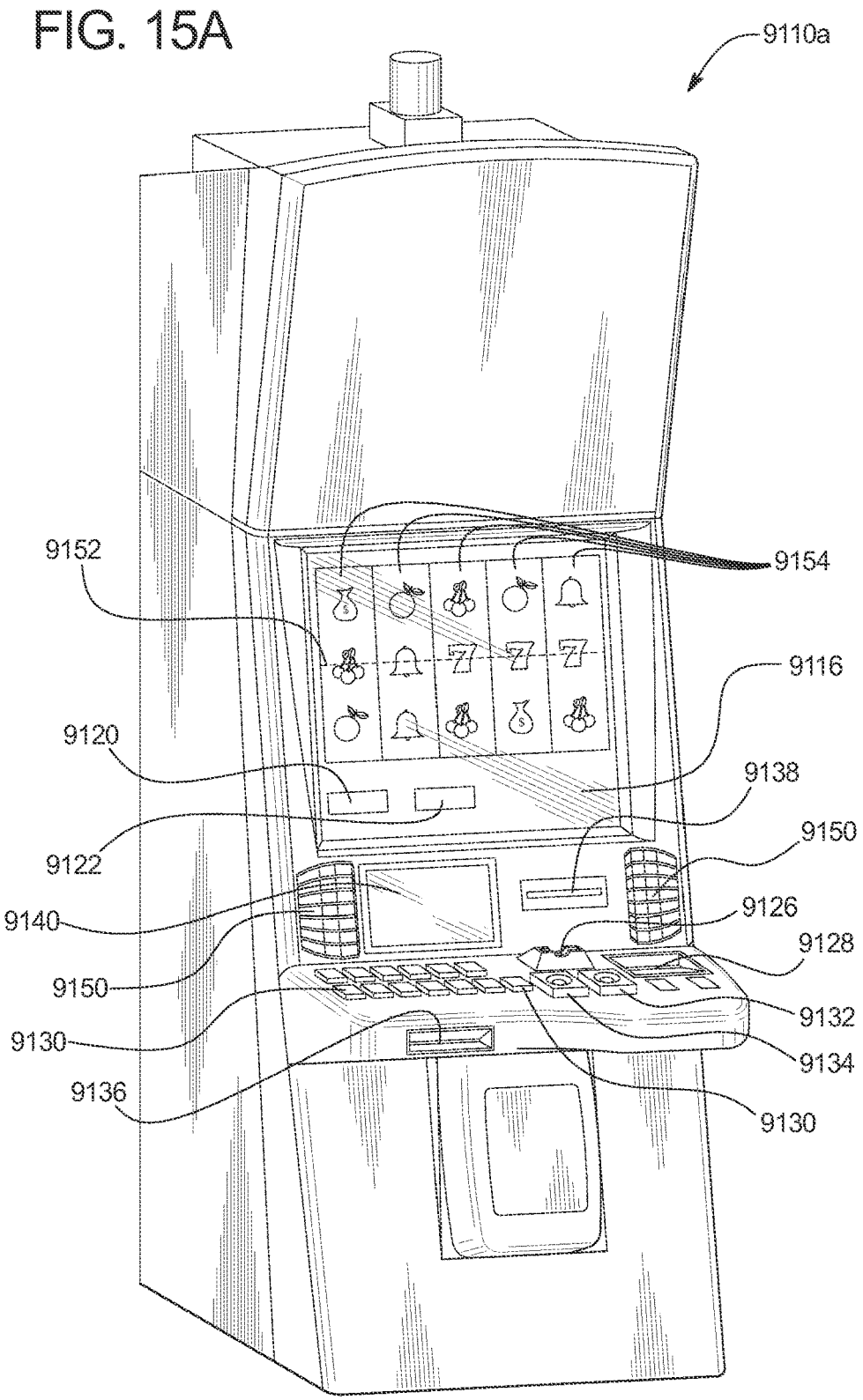
FIGS. 15A and 15B are perspective views of example alternative embodiments of the gaming system disclosed herein.
Figure 15B:
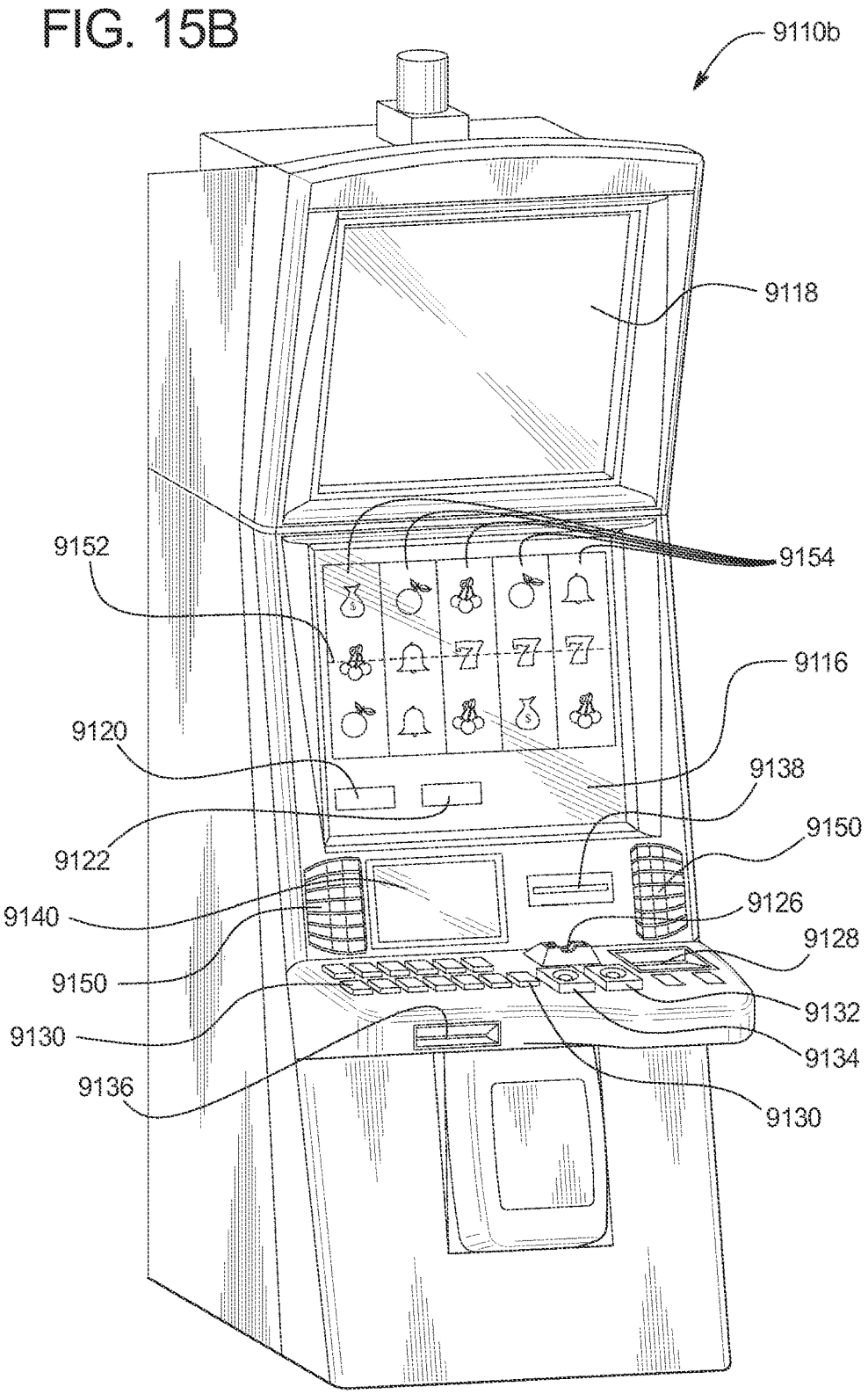

In various embodiments, the EGM includes one or more input devices. The input devices may include any suitable device that enables an input signal to be produced and received by the at least one processor of the EGM. The example EGM illustrated in FIG. 14B includes at least one input device 9030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 15A and 15B illustrate example EGMs that each include the following payment devices: (a) a combined bill and ticket acceptor 9128, and (b) a coin slot 9126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 15A and 15B each include a game play activation device in the form of a game play initiation button 9132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 15A and 15B each include a cash out device in the form of a cash out button 9134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 15A and 15B each include a card reader 9138. The card reader is configured to read a player identification card inserted into the card reader.

In various embodiments, the EGM includes one or more output devices. The example EGM illustrated in FIG. 14B includes at least one output device 9060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 15A includes a central display device 9116, a player tracking display 9140, a credit display 9120, and a bet display 9122. The example EGM illustrated in FIG. 15B includes a central display device 9116, an upper display device 9118, a player tracking display 9140, a player tracking display 9140, a credit display 9120, and a bet display 9122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 15A and 15B each include ticket generator 9136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 15A and 15B each include a plurality of speakers 9150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 15A and 15B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 15A and 15B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281561 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 15A and 15B each include a payline 9152 and a plurality of reels 9154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one display device supported by the housing;

at least one input device supported by the housing;

at least one processor;

at least one memory device that stores a plurality of instructions which, when executed by the at least one processor, cause the at least one processor to operate with the at least one display device to display at least one play of at least one game, the gaming system having a pre-determined volatility level; and a volatility marker that is separate from and independent from: the at least one display device; the at least one input device; and any processor-generated image of any of the display devices of the gaming system, said volatility marker including an interior side and an exterior side, said interior side of the volatility marker attached to the housing and the exterior side of said volatility marker including at least two simultaneously viewable different volatility level indicators, wherein:

(i) a first of the volatility level indicators has:

(a) a first shape indicating the pre-determined volatility level of the gaming system, and (b) a first size indicating the pre-determined volatility level of the gaming system, and (ii) a second of the volatility level indicators has:

(a) a second shape different than the first shape, the second shape indicating a second different volatility level different than the first pre-determined volatility level and not indicating any volatility level of the gaming system, and (b) a second size different than the first size, the second size indicating the second volatility level and not indicating any volatility level of the gaming system.

2. The gaming system of claim 1, wherein the first of the volatility level indicators has a first color indicating the pre-determined volatility level of the gaming system.

3. The gaming system of claim 2, wherein the second of the volatility level indicators does not include the first color.

4. The gaming system of claim 1, wherein a third of the volatility level indicators has:

(i) a third shape different than the first shape and the second shape, the third shape indicating a third volatility level different than the pre-determined volatility level and different than the second volatility level and not indicating any volatility level of the gaming system, and (ii) a third size different than the first size and the second size, the third size indicating the third volatility level and not indicating any volatility level of the gaming system.

5. The gaming system of claim 4, wherein the first of the volatility level indicators has a first color indicating the pre-determined volatility level and neither the second of the volatility level indicators nor the third of the volatility level indicators includes said first color.

6. The gaming system of claim 1, wherein the exterior side of the gaming system volatility marker includes at least two distinct sections, a first one of the sections associated with the first of the volatility level indicators and a second, different one of the sections associated with the second of the volatility level indicators.

7. The gaming system of claim 1, wherein the second, different volatility level is a volatility level of a second, different gaming system.

8. The gaming system of claim 1, wherein the first of the volatility level indicators is activated and the second of the volatility level indicators is not activated.

9. The gaming system of claim 1, wherein the first shape is a first wave shape having a first quantity of peaks and the second shape is a second different wave shape having a second different quantity of peaks.

10. A gaming system comprising:

a housing;

at least one display device supported by the housing;

at least one input device supported by the housing;

at least one processor;

at least one memory device which stores a plurality of instructions, which when executed by the at least one processor, cause the at least one processor to operate with the at least one display device to display plays of at least one game, the gaming system having a pre-determined volatility level; and a volatility marker that is separate from and independent from: the at least one display device; the at least one input device; and any processor-generated image of any of the display devices of the gaming system, said volatility marker including an interior side and an exterior side, said interior side of the volatility marker attached to the housing and the exterior side of said volatility marker including a first volatility level indicator having: (i) a first shape indicating the pre-determined volatility level of the gaming system, and (ii) a first size indicating the pre-determined volatility level of the gaming system, wherein the first volatility level indicator is different than a second volatility level indicator, wherein the second volatility level indicator has: (a) a second shape different than the first shape, the second shape indicating a second volatility level different than the first pre-determined volatility level and not indicating any volatility level of the gaming system, and (b) a second size different than the first size, the second size indicating the second volatility level and not indicating any volatility level of the gaming system.

11. The gaming system of claim 10, wherein the first volatility level indicator has a first color indicating the pre-determined volatility level.

12. The gaming system of claim 11, wherein the second volatility level indicator does not include the first color.

13. The gaming system of claim 10, wherein the first volatility level indicator and the second volatility level indicator are different than a third volatility level indicator having:

(i) a third shape different than the first shape and the second shape, the third shape indicating a third volatility level different than the pre-determined volatility level and different than the second volatility level and not indicating any volatility level of the gaming system, and (ii) a third size different than the first size and the second size, the third size indicating the third volatility level and not indicating any volatility level of the gaming system.

14. The gaming system of claim 13, wherein the first volatility level indicator has a first color indicating the pre-determined volatility level and neither the second volatility level indicator nor the third volatility level indicator includes said first color.

15. The gaming system of claim 10, wherein the second, different volatility level is a volatility level of a second, different gaming system.

16. The gaming system of claim 10, wherein the first volatility level indicator is activated.

17. A method of manufacturing a gaming system, said method comprising:

(a) identifying a pre-determined volatility level of the gaming system having a housing, and (b) affixing a volatility marker to the housing of the gaming system, said volatility marker being separate from and independent from any display device or input device included in the gaming system, said volatility marker being separate from and independent from any processor-generated image of any of the display devices of the gaming system, said volatility marker including an interior side and an exterior side, said exterior side of said volatility marker including at least two simultaneously viewable different volatility level indicators, wherein:

(i) a first of the volatility level indicators has:

(a) a first shape indicating the pre-determined volatility level of the gaming system, and (b) a first size indicating the pre-determined volatility level of the gaming system, and (ii) a second of the volatility level indicators has:

a) a second shape different than the first shape, the second shape indicating a second volatility level different than the pre-determined volatility level and not indicating any volatility level of the gaming system, and (b) a second size different than the first size, the second size indicating the second volatility level and not indicating any volatility level of the gaming system.

18. The method of claim 17, wherein the first volatility level indicator has a first color indicating the pre-determined volatility level.

19. The method of claim 18, wherein the second volatility level indicator does not include the first color.

20. The method of claim 17, wherein a third of the volatility level indicators has:

(i) a third shape different than the first shape and the second shape, the third shape indicating a third volatility level different than the pre-determined volatility level and different than the second volatility level and not indicating any volatility level of the gaming system, and (ii) a third size different than the first size and the second size, the third size indicating the third volatility level and not indicating any volatility level of the gaming system.

21. The method of claim 20, wherein the first of the volatility level indicators has a first color indicating the pre-determined volatility level and neither the second of the volatility level indicators nor the third of the volatility level indicators includes said first color.

22. The method of claim 17, wherein the exterior side of the gaming system volatility marker includes at least two distinct sections, a first one of the sections associated with the first of the volatility level indicators and a second, different one of the sections associated with the second of the volatility level indicators and not indicating any volatility level of the gaming system.

23. The method of claim 17, wherein the second, different volatility level is a volatility level of a second, different gaming system.

24. The method of claim 17, which includes activating the first of the volatility level indicators and not activating the second of the volatility level indicators.

25. The method of claim 17, wherein the first shape is a first wave shape having a first quantity of peaks and the second shape is a second different wave shape having a second different quantity of peaks.

26. A method of manufacturing a gaming system, said method comprising:

(a) identifying a pre-determined volatility level of the gaming system having a housing, and (b) affixing a volatility marker to the gaming system, said volatility marker being separate from and independent from any display device or input device included in the gaming system, said volatility marker being separate from and independent from any processor-generated image of any of the display devices of the gaming system, said volatility marker including an interior side and an exterior side, said interior side of the volatility marker attached to the housing and the exterior side of said volatility marker including a first volatility level indicator having:

(i) a first shape indicating the pre-determined volatility level of the gaming system, and (ii) a first size indicating the pre-determined volatility level of the gaming system, wherein the first volatility level indicator is different than a second volatility level indicator, wherein the second volatility level indicator has:

(a) a second shape different than the first shape, the second shape indicating a second volatility level different than the pre-determined volatility level and not indicating any volatility level of the gaming system, and (b) a second size different than the first size, the second size indicating the second volatility level and not indicating any volatility level of the gaming system.

27. The method of claim 26, wherein the first volatility level indicator has a first color indicating the pre-determined volatility level.

28. The method of claim 26, wherein the second volatility level indicator does not include the first color.

29. The method of claim 26, wherein the first volatility level indicator and the second volatility level indicator are different than a third volatility level indicator having:

(i) a third shape different than the first shape and the second shape, the third shape indicating a third volatility level different than the pre-determined volatility level and different than the second volatility level and not indicating any volatility level of the gaming system, and (ii) a third size different than the first size and the second size, the third size indicating the third volatility level and not indicating any volatility level of the gaming system.

30. The method of claim 29, wherein the first volatility level indicator has a first color indicating the pre-determined volatility level and neither the second volatility level indicator nor the third volatility level indicator includes said first color.

31. The method of claim 26, wherein the second, different volatility level is a volatility level of a second, different gaming system.

32. The method of claim 26, which includes activating the first volatility level indicator.

* * * * *